US006459657B1

(12) United States Patent
Takada et al.

(10) Patent No.: US 6,459,657 B1
(45) Date of Patent: Oct. 1, 2002

(54) TIME INFORMATION REPEATING INSTALLATION AND TIME INFORMATION CONTROL SYSTEM

(75) Inventors: Akinari Takada, Tokyo (JP); Kenji Fujita, Tokyo (JP); Masahiro Sase, Tokyo (JP); Shinya Yoshida, Tokyo (JP); Masahiro Tanoguchi, Tokyo (JP); Kenichi Nemoto, Tokyo (JP)

(73) Assignees: Citizen Watch Co., Ltd., Tokyo (JP); Rhythm Watch Co., Ltd., Tokyo (JP)

( * ) Notice: Subject to any disclaimer, the term of this patent is extended or adjusted under 35 U.S.C. 154(b) by 0 days.

(21) Appl. No.: 09/504,590

(22) Filed: Feb. 15, 2000

(30) Foreign Application Priority Data

| | | |
|---|---|---|
| Feb. 16, 1999 | (JP) | 11-036584 |
| Mar. 31, 1999 | (JP) | 11-092436 |
| Apr. 22, 1999 | (JP) | 11-114628 |
| May 28, 1999 | (JP) | 11-148960 |

(51) Int. Cl.[7] ..... G04C 11/00; G04C 13/00; G04C 11/02

(52) U.S. Cl. ..... 368/46; 368/47

(58) Field of Search ..... 368/10, 46, 47, 368/52, 53, 55; 455/73, 78

(56) References Cited

U.S. PATENT DOCUMENTS

| | | | | |
|---|---|---|---|---|
| 4,210,901 A | * | 7/1980 | Whyte et al. | 340/301 R |
| 5,677,895 A | * | 10/1997 | Mankovitz | 368/10 |
| 6,288,977 B1 | * | 9/2001 | Yoshida et al. | 368/47 |

FOREIGN PATENT DOCUMENTS

| | | |
|---|---|---|
| JP | 9113647 | 5/1997 |

* cited by examiner

*Primary Examiner*—Vit Miska
(74) *Attorney, Agent, or Firm*—Dickstein Shapiro Morin & Oshinsky LLP

(57) ABSTRACT

A time information repeating installation in a radio clock system, which receives advance notice information, distinguishes advance notice content by detecting means 9, sets a transmission start time by addition setting means 10 in accordance with the content, sets an additional period by change period setting means 11, and stores the content into transmission start time storage means 12. When the stored time agrees with the time of a main counter 8, transmission starts. Therefore, even when a sudden time change occurs, the repeating installation can perform transmission at the reception timing of a subsidiary device. The subsidiary device can effectively update time data for summer or daylight savings time.

22 Claims, 21 Drawing Sheets

TIME INFORMATION REPEATING INSTALLATION AND TIME INFORMATION CONTROL SYSTEM

BACKGROUND OF THE INVENTION (i) Field of the Invention

The present invention relates to a standard radio signal repeating installation which receives a standard radio signal for transmitting time information, corrects it own time, and transmits the time information to a subsidiary device to thereby correct the time held by the subsidiary device. The present invention also relates to a time information control system using this repeating installation.

(ii) Description of the Related Art

Radio signals containing time information are broadcast throughout the world. For example, in Japan a standard radio is broadcast by Japan's Ministry of Post and Telecommunications, and a radio correction clocks for receiving this radio signal to correct displayed time are well known.

The transmitted information includes, for example, minute, hour, and day counted from January 1.

In the configuration shown in FIG. 3B, for the transmission of time data, one minute is used as one frame at a rate of one bit per second, and the above-listed information of minute, hour, and day counted from January 1 is encoded within this frame with a BCD code. Moreover, the data to be transmitted includes a P code marker in addition to 0 and 1. This P code exists in several places in one frame and appears at a positive minute (0 second), 9 seconds, 19 seconds, 29 seconds, 39 seconds, 49 seconds, 59 seconds. This P code continuously appears only once at 59 seconds, 0 second in one frame, and this continuously appearing position corresponds to a positive minute position.

Auxiliary equipment of the radio wave correction clock include repeating installations, concerning which a large number of patents have been issued. For example, Japanese Patent Application Laid-Open No. Hei 9-113647 relates to a so-called parentage clock, in which a parent device receives data transmitted from a base station, and then optically transmits the received data to a subsidiary equipment. In this technique the parent or subsidiary device must be placed in a transmission or reception state by switch operation, which is troublesome. Moreover, for a switch to summer time or in other cases when the time information suddenly changes, a user must perform the SW operation, for which they must be aware of the know the changeover period and new time value.

As described above, it is troublesome for the user to place the parent or subsidiary equipment in the transmission or reception state by the SW operation. Another problem is that every time the time data suddenly changes as for daylight savings time, the user must recognize the change and perform the operation. An object of the present invention is to provide a repeating installation and a time control system in which the time data of a subsidiary device can be automatically updated, even during changeover between standard and daylight savings time, referred to in this specification as summer time or ST and winter time or WT.

SUMMARY OF THE INVENTION

To attain the above-described object, according to the present invention, there is provided a time information repeating installation comprising receiving means for receiving information including standard time information; timing means for measuring time based on the time information obtained by the receiving means; transmitting means for transmitting, at a predetermined time, the information obtained from the receiving means; and change recognizing means for recognizing a change of said standard time information, wherein said transmitting means performing a transmitting operation based on an output of the change recognizing means at a time different from said predetermined time.

The change recognizing means preferably recognizes changeover advance notice information of standard time information.

It may also be preferable that the transmitting means performs the transmitting operation at said predetermined time and at a time interval corresponding to correction time recognized by said change recognizing means.

It may also be preferable to dispose change period setting means for setting a period in which the transmitting means performs the transmitting operation at the time different from the predetermined time.

The change period of the change period setting means is preferably adjustable.

The change recognizing means for recognizing the change of the standard time information preferably recognizes a changeover of summer time and winter time.

It may further be preferable to provide the time information repeating installation with computing means for computing a difference between the time information obtained by the receiving means and the time measured by the timing means, so that, when the difference outputted from the computing means is greater than or equal to a predetermined value, the transmitting means performs the transmitting operation at the predetermined time and at the time based on the difference.

It may be preferable to dispose the change recognizing means for recognizing the change, so that the computing means operates on receiving the output of the change recognizing means.

The change recognizing means may preferably comprise detecting means for detecting a time change advance notice bit included in the standard time information.

The change recognizing means may also preferably comprise calendar information holding means for holding the present calendar information, changeover day holding means for holding a time information changeover day, and comparing means for comparing the calendar information held by the calendar information holding means and the changeover day holding means.

The above-described time information repeating installation, and a time display for receiving the information outputted at least from the time information repeating installation at the predetermined time may preferably be included.

Moreover, according to the present invention, there is provided a time information control system comprising a time information repeating installation comprising receiving means for receiving information including standard time information, timing means for measuring time based on the time information obtained by the receiving means, and transmitting means for transmitting the information obtained from the receiving means at a predetermined time; and a time display comprising receiving means for receiving the information transmitted from the time information repeating installation at a predetermined time, timing means for measuring the time based on the time information obtained by the receiving means, and change recognizing means for recognizing a change of the standard time information, so that the receiving means of the time display performs a receiving operation based on the output of the change recognizing means at the time different from the predetermined time.

The transmitting means of the time information repeating installation preferably transmits a time change advance notice bit included in the standard time information, and the change recognizing means preferably comprises detecting means for detecting the time change advance notice bit of the standard time information.

The receiving means of the time display may preferably perform reception, even at the predetermined time.

It may also be preferable to dispose change period setting means for setting a period in which the receiving means of the time display performs the reception at a time different from the predetermined time.

The change period of the change period setting means may be adjustable. The change recognizing means may be preferably constituted of calendar information holding means for holding the present calendar information, changeover day holding means for holding a time information changeover day, and comparing means for comparing the calendar information held by both holding means.

It may be preferable that the change recognizing means for recognizing the change of the standard time information be able to recognize the changeover to the summer time and the winter time.

Furthermore, according to the present invention, there is preferably provided a time information repeating installation comprising receiving means for receiving a signal including standard time information; transmitting means for transmitting the time information obtained from the signal to a subsidiary equipment; and control means for controlling transmission and reception timings, such that, when a discontinuous changeover of the standard time information is expected, a reception time is set to the control means at the same time as a predetermined changeover time or a short time after the changeover time, and a transmission time is set to a short time after the reception time.

An interval from the reception time to the transmission time may be preferably set to be shorter than the interval to the next reception time.

It may further be preferable that while the predetermined transmission timing by said control means be normally set to a short time before a positive time, and be changed to a short time after the positive time during detection of advance notice information of said discontinuous changeover.

DETAILED DESCRIPTION OF THE PREFERRED EMBODIMENTS

A new transmission data format of a long wave standard radio signal formalized in 1999 will be described before describing a concrete practice mode.

Figure 3:
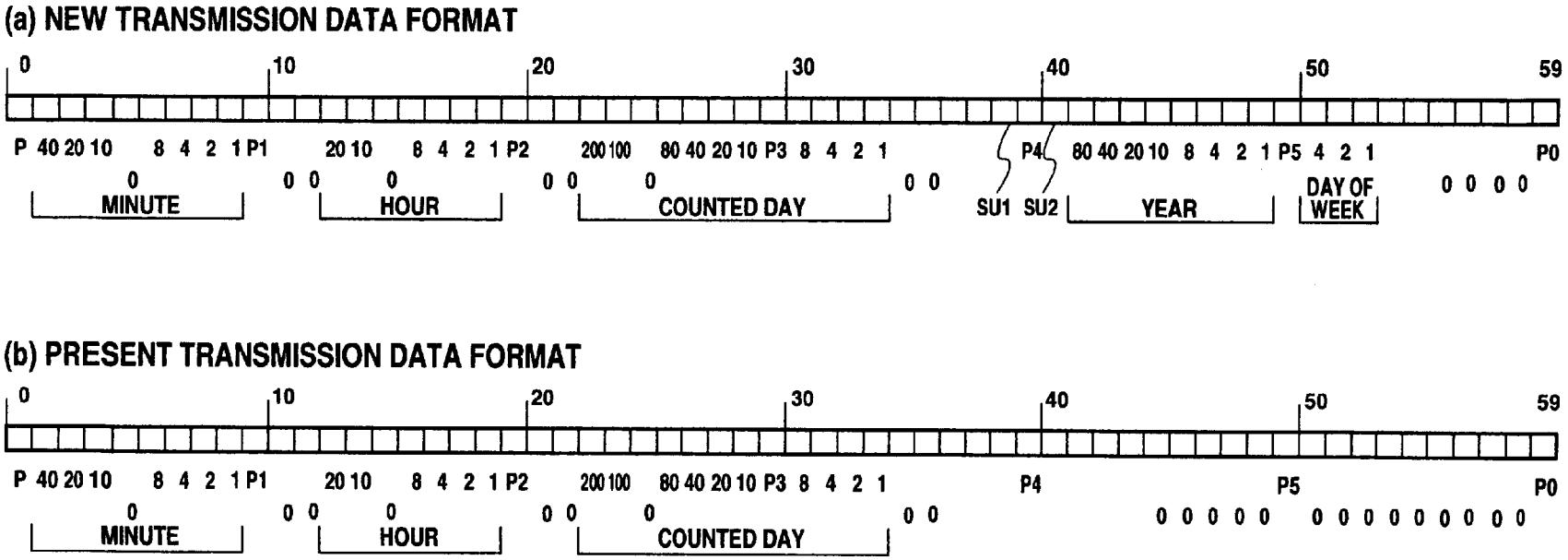
FIGS. 3(*a*) and 3(*b*) diagrams showing a format of standard radio signal transmission data.

For Japanese standard radio signals, there now exists an experimental station, which is scheduled to be a formal station in 1999. This station was established for the purpose of fully utilizing the standard radio bandwidth. With this, as shown in FIG. 3A, added to the present (experimental station) transmission data are lower two year digits, day of the week, minute parity, hour parity, preliminary bits which are to be used during ST introduction, and leap bits. In the formal station the data transmitting method is the same as the present method, in that one minute is used as one frame at a rate of one bit/second. Particularly the preliminary bits will be described hereinafter among these newly added information.

As shown in Table 1, SU1, SU2 are used as the preliminary bits, and they are prepared to allow for future expansion of information. When the bits are utilized in ST information, the information modes are: "there is no change to summer time within six days", in SU1=SU=0; "there is a change to summer time within six days" in SU1=1, SU2=0; "summer time is being carried out" in SU1=0, SU2=1; and "summer time will end within six days" in SU1=SU2=1. With respect to the changeover to the summer time, such a system has yet to be introduced in Japan, but in many European countries, the change is performed at midnight.

TABLE 1

Preliminary Bits (Example of Use as Summer Time)

| SU1 | SU2 | Meaning |
|---|---|---|
| 0 | 0 | No change to summer time within six days |
| 1 | 0 | Change to summer time within six days |
| 0 | 1 | Summer time being carried out (no change to ordinary time from summer time within six days) |
| 1 | 1 | Summer time will end within six days |

Figure 1:
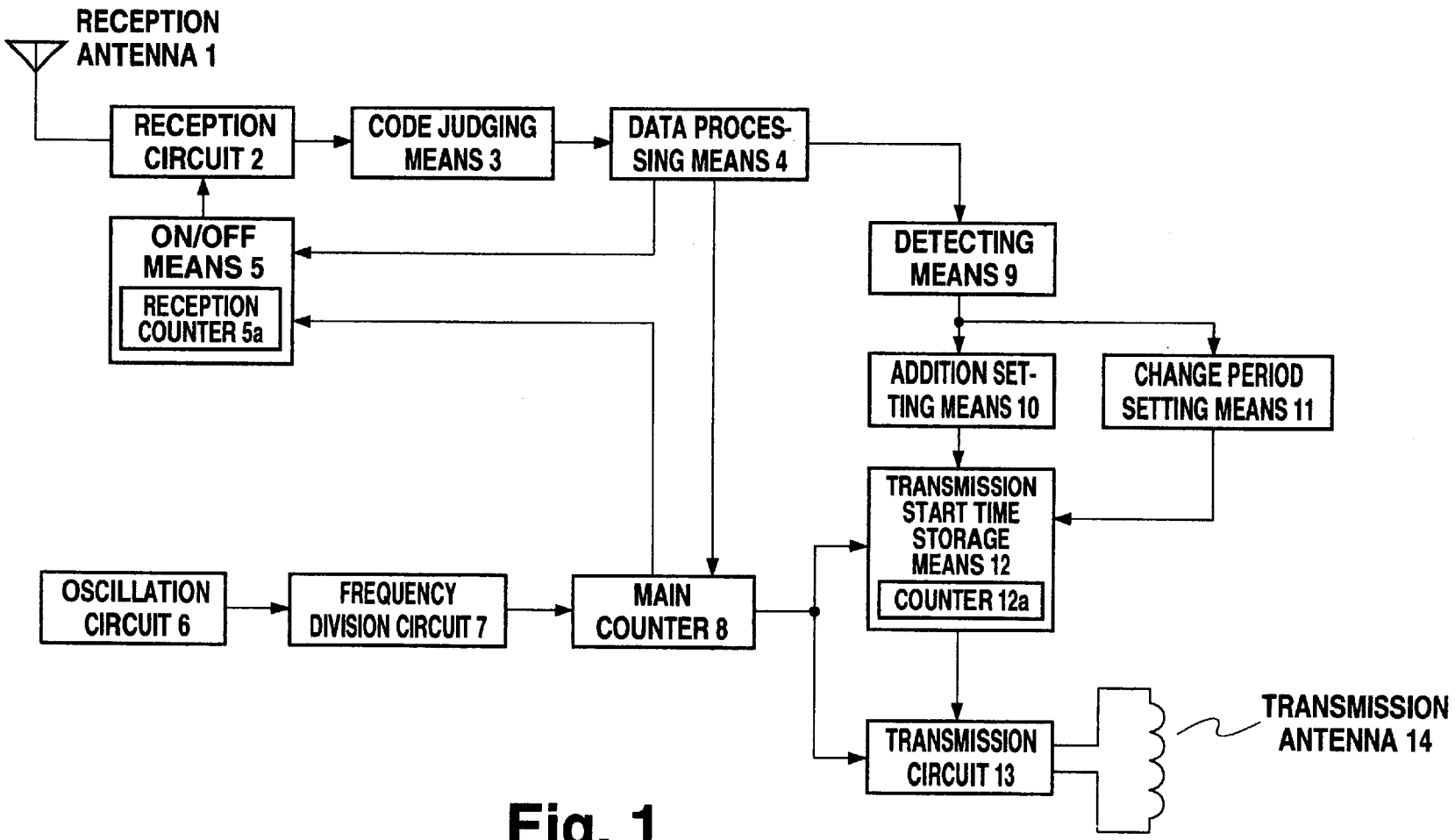
FIG. 1 is a system block diagram showing a first embodiment of the present invention.

FIG. 1 is a block diagram showing a first embodiment of the present invention. Numeral 1 denotes an antenna for receiving standard radio signals; 2 denotes a reception circuit for performing amplification, filter processing, and wave detection of the signal received by the reception antenna 1; 3 denotes code judging means for judging 0, 1, and P from a demodulated waveform of the reception circuit 2; 4 denotes data processing means for processing the code output from the code judging means 3 to provide information for time or the like 5 denotes ON/OFF means for storing the time to start reception and turning on the reception circuit 2 when the time with the time of a main counter 8; 5*a* denotes a reception counter for counting while reception is performed, 6 denotes an oscillation circuit; and 7 denotes a frequency division circuit. Numeral 9 denotes detecting means for detecting an advance notice content output from the data processing means 4; 10 denotes addition setting means for setting the addition of the number of transmissions in accordance with the advance notice content judged by the detecting means 9; 11 denotes change period setting means for setting a period for the adding of the transmission time and the number of transmissions; 12 denotes transmission start time storage means for storing the time set as an initial value and transmission time changed in accordance with the result of the addition setting means 10 and change period setting means 11; 12*a* denotes a counter for subtracting the period set by the change period setting means 11 based on the information from the main counter 8 every day; 13 denotes a transmission circuit for generating a modulation signal based on the data of the main counter 8; and 14 denotes a transmission antenna. These constitute a device according to one embodiment of the present invention.

The operation of the device according the embodiment of FIG. 1 will next be described. When the time set in the ON/OFF means 5 agrees with the time of the main counter 8, the ON/OFF means 5 transmits a reception start command to the reception circuit 2, the reception circuit 2 begins reception to perform the amplification, frequency filter processing, and wave detection of the radio wave obtained from the antenna 1, and a wave detection result is output from the reception circuit 2. The code judging means 3 judges each 0, 1, and P code from the wave detection result, and the data processing means 4 performs processes the data to generate time and calendar data and advance notice information. The data processing means 4 then transmits the obtained data to the main counter 8 if the data updates the value of the main counter, and simultaneously outputs a reception end signal to the ON/OFF means 5. For present data and other unrecognizable data, the value of the main counter 8 is not updated, and the reception is continued to obtain the next data. When the counter for counting the reception time in the ON/OFF means 5 exceeds a certain constant value, the reception ends. If no correct data can be obtained during this time, the data of the main counter 8 is not updated. When the correct data can be obtained, the data of the main counter 8 is updated as described above. Moreover, when there is no advance notice information and when the time initially set in the transmission start time storage means 12 agrees with the updated time of the main counter 8, the transmission circuit 13 generates the modulation signal based on the data of the main counter 8, and transmits the signal via the transmission antenna 14. Conversely, when advance notice information is present, the main counter 8 is updated and the detecting means 9 simultaneously confirms the content of the advance notice. In accordance with the advance notice content detected here, the addition setting means 10 sets the transmission time and the number of transmissions, the change period setting means 11 sets the period to be added, and then this additional transmission information is stored in the transmission start time storage means 12. Moreover, the counter 12*a* sets the counter based on the information stored in the transmission start time storage means 12. In a similar manner as when there is no advance notice information, if the time stored in the transmission start time storage means 12 agrees with the time of the main counter 8, the transmission circuit 13 generates a modulation signal based on the data of the main counter 8, and transmits the signal via the transmission antenna 14. These operations are performed until the counter 12*a* reaches zero. At zero, the additional transmission time stored in the transmission start time storage means 12 is deleted.

Figure 2:
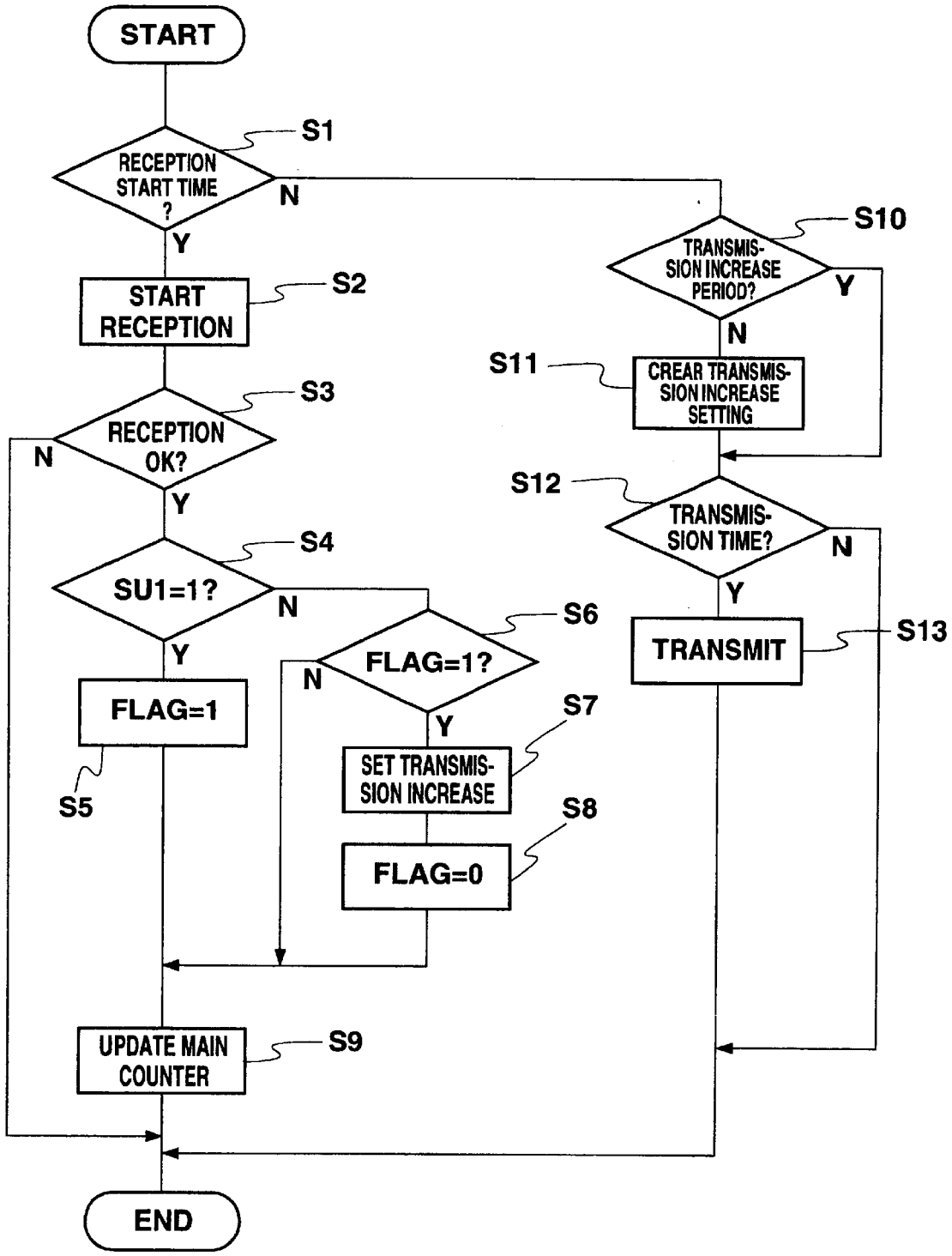
FIG. 2 is a flowchart showing one example of an operation of the first embodiment shown in FIG. 1.

A concrete example of advance notice will next be described. FIG. 2 shows a process flow with respect to summer time (ST)/winter time (WT). The details of advance notice information processing will be described in conformity with the above-described operation.

In the example shown in FIG. 2, for the initial setting, the reception start time 3:00, 4:00 is stored in the ON/OFF means 5, 4:30 is stored in the transmission start time storage means 12, the value of the counter 12*a* is zero, and no advance notice information is in the main counter 8. Also, the switching of ST/WT and generation of advance notice information are performed at 3:00. (Here, the ST/WT switch 3:00 indicates that when WT is changed to ST, the clock moves to 4:00 one minute after 2:59, or, when ST is changed to WT, the click returns to 3:00 one minute after 3:59.)

Figure 4:
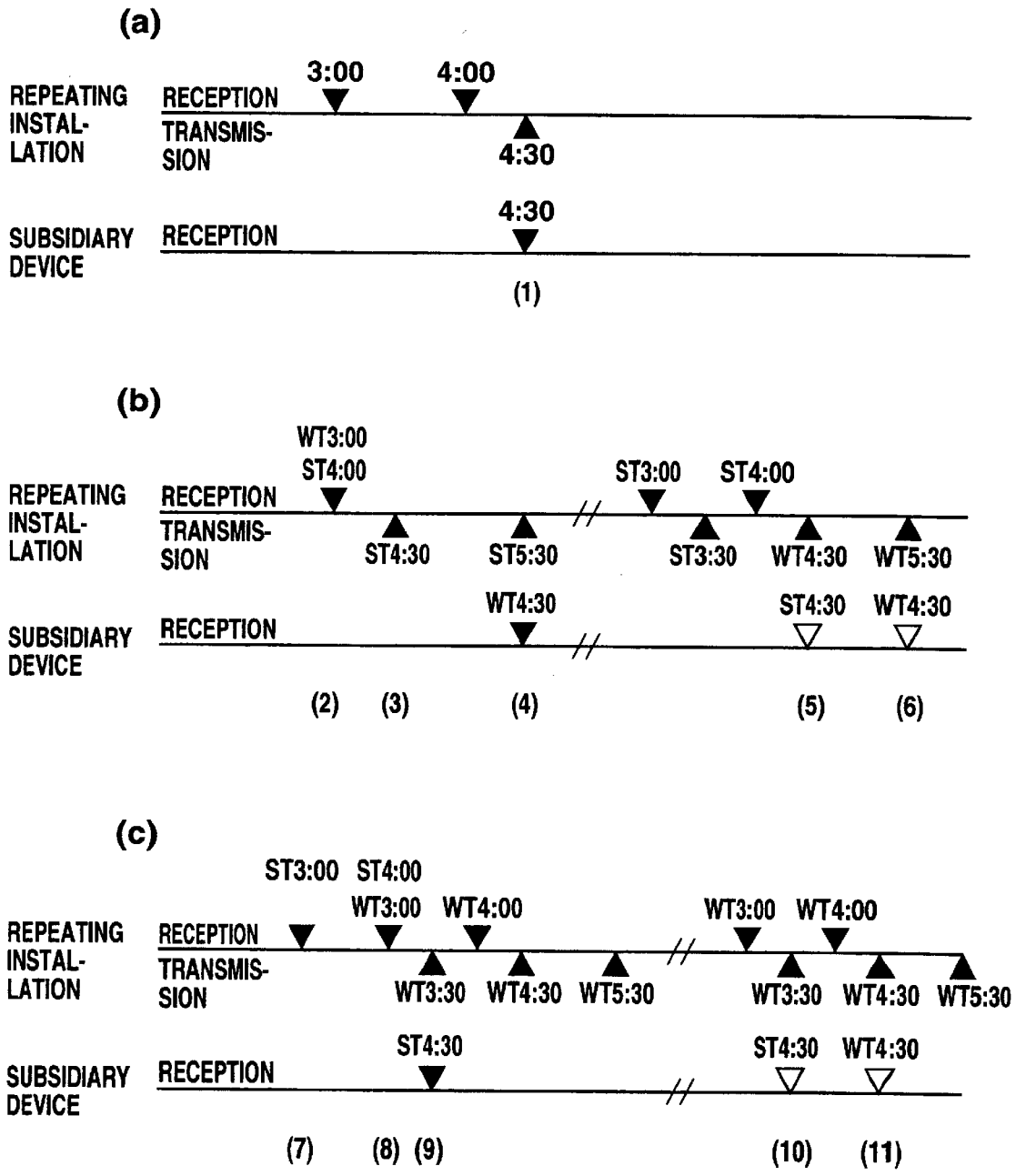
FIGS. 4(*a*)–4(*c*) are time charts showing one example of the operation of the first embodiment.

An example in which no advance notice occurs will first be described. When the main counter reaches 3:00, it is judged at S1 whether it is a reception start time and the process proceeds to S2. Subsequently, it is judged at S3 whether the reception is successful. When successful, it is next judged at S4 whether there is an advance notice. Because no advance notice is generated here, the process proceeds to S6. Since FLAG indicating the state of SU1 during the previous reception is zero here (1 when SU1=1, 0 when SU1=0), the process proceeds to S9, and the value of the main counter is updated. When time elapses until 4:00, the processing similar to that at 3:00 is performed. When time further elapses until 4:30, the process continues to S10 from S1, and it is judged here whether it is a transmission increase period. The transmission increase period is not set until SU1 indicates one in S4 and FLAG indicates one in S6. Therefore, the process proceeds to S12 via S11, and it is judged whether it is a transmission time. Since the transmission time is judged, the process proceeds to S13 and transmission is performed. FIG. 4A shows a time chart of transmission/reception of the repeating installation and reception of the subsidiary equipment during the ordinary time. In the chart, the repeating installation performs transmission and the subsidiary equipment side performs reception at time (1) so that the time data of the subsidiary equipment is updated.

Another case will be described in which the advance notice information is present and WT is changed to ST. At 3:00 when the transmission data starts to output ST advance notice information (SU1=1), it is the reception time of the repeating installation, and reception is performed. When the reception is OK at S3, SU1 is one at S4 in this case, FLAG is set to one at S5, and the main counter is updated at S9. For the reception in the advance notice period, such processing is repeatedly performed. Since the transmission is similar to the above-described transmission with no advance notice information, the description thereof is omitted here.

Several days later, the advance notice is canceled and the time is changed to ST at 3:00. The changeover day will be described below. At 3:00 the process continues through S1, S2, S3. When the reception is OK, the process proceeds to S4, and the state of SU1 is confirmed. At this time, SU1 is cleared, SU2 is set to one, and the process continues to S6. At S6 FLAG is still one, which indicates that the advance notice is changed to ST with this reception. Therefore, additional transmission is set at S7. (In this embodiment, the additional transmission is set to 3:30, 5:30 for seven days. In FIG. 1, "3:30 and 5:30" are stored in the transmission start time storage means 12, and "7" is set to the counter 12*a*. Moreover, the counter 12*a* subtracts one every day.) Subsequently, at S8 FLAG is cleared, and at S9 the main counter is updated to ST, that is, advanced by one hour. (FIG. 4B is a time chart showing the changeover to ST from WT, and the above-described corresponds to time (2).) When time elapses until 4:30, the process continues to S10 from S1 to check the change period, and it is then judged at S12 whether it is the transmission time. In this example, because the value is the transmission time, transmission is started at S13. However, because the subsidiary equipment is not synchronized with the transmission, the reception cannot be performed (time (3) in FIG. 4B). When time elapses until 5:30, the process continues to S10 from S1 to check a transmission increase period. When transmission is performed at 5:30, the process continues to S12 (time (4) in FIG. 4B). Here, the subsidiary equipment performs reception. When the reception is OK, the time is updated to a correct time, that is, ST. In this case, on and after the next day the repeating installation performs transmission, and the subsidiary equipment performs reception at ST 4:30 (time (5) in FIG. 4B). When the reception is not OK, the next day the repeating installation performs transmission and the subsidiary equipment performs reception at timing (6) of FIG. 4B. Here, when the reception is OK, on and after the next day the repeating installation performs transmission and the subsidiary equipment performs reception at timing (5) of FIG. 4B as described above. The above-described operation is performed until the counter 12*a* reaches zero. The counter 12*a* of zero indicates that the transmission increase period ends, and the process continues to S11 after the judgment of S10 so that the increased/set transmission time (3:30, 5:30) is cleared. In this case, even if the time of the repeating installation and subsidiary equipment deviates, but when the reception of the subsidiary equipment is successful in the period in which the transmission is added, the subsidiary equipment can obtain the correct time from the repeating installation.

The changeover to WT from ST will next be described. It is assumed in ST that SU2 is one and the transmission data from the base station outputs ST advance notice information (SU1=1).

At 3:00 it is reception time of the repeating installation, and the process continues to S2 from S1 to perform reception. When the reception is OK at S3, the process continues to S4. In this case, because SU1 is one, the process continues to S5 to set FLAG to one, and the process continues to S9 to update the main counter. Moreover, transmission is performed at 4:30, and such processing is repeatedly performed during the advance notice period.

Several days later, the advance notice is canceled and the time is changed to WT. The changeover day will be described below. At ST 3:0, the process continues through S1, S2, S3. When the reception is OK, the process continues to S4, and the SU1 state is confirmed. Since SU1 is still one at this time, the process continues to S9 via S5 (time (7) of FIG. 4C). When time elapses until ST 4:00, the repeating installation starts the reception and the process continues through S1, S2, S3. When the reception is OK at S3, the process continues to S4. At this time ST is changed to WT, the main counter of the repeating installation is updated to WT, simultaneously the advance notice ends, and SU1 also becomes zero. Specifically, the process continues to S6 from S4; FLAG is still one at S6, indicating that the advance notice is changed to WT with this reception; and the additional transmission is set at S7 (in the present embodiment the additional transmission is performed at 3:30, 5:30 for seven days). Subsequently, the process continues to S8 to clear FLAG, then at S9 the main counter is updated to WT, that is, set back one hour (time (8) of FIG. 4C). When time elapses until 3:30, the process continues to S10 from S1, and it is checked whether it is a transmission increase period. Because it is the transmission increase period, the process continues to S12 to judge whether it is transmission time. In this example, because judgement for transmission time is positive, the process continues to S13 to start transmission. In this case, the subsidiary equipment is still in ST, the reception time 4:30 of the subsidiary equipment is recognized, and the reception is started (time (9) of FIG. 4C). Here, when the reception of the subsidiary equipment is successful, the time is updated to WT. Thereafter, at WT 4:30 the repeating installation performs transmission and the subsidiary equipment performs reception (time (11) of FIG. 4C). When the reception is not OK, the repeating installation performs transmission, and the subsidiary equipment performs reception at timing (10) of FIG. 4C. This is similar to the operation for the changeover to ST from WT, and the effect is also similar.

As described above, during the changeover of ST/WT, by adding the transmission to the ordinary transmission, the time data can be updated to the correct time on the changeover day, thereby solving the problem of the subsidiary equipment being unable to perform reception with respect to the transmission from the repeating installation.

Environments under which the subsidiary device cannot perform reception on the changeover day can also be stipulated. Therefore, the additional transmission is not limited to the changeover day, and, as described in the present embodiment, by continuing the additional transmission for a certain number of days, the changeover can be realized at the earliest possible opportunity.

In the example used to described present embodiment, the reception time of the subsidiary equipment is set once to 3:30, but the present invention is not limited to this. For example, the reception time of the subsidiary equipment can be s set to 3:30, and 4:30 such that the transmission time of the repeating installation is initially set to 3:30 and the transmission is added to 4:30 when the changeover of ST or WT occurs. In this manner, the reception time of the subsidiary device and the transmission time of the repeating installation are set to two or more times at an interval having at least a time difference corresponding to the time corrected by the changeover. Therefore, the main counter of the subsidiary equipment can be updated on the changeover day and the effect equal to that of the above-described embodiment can be obtained.

While the above example the additional transmission time is set to 3:30, 5:30, the present invention is not limited to this as long as the time has a time difference from the ordinary transmission time by the time corrected by the changeover.

Moreover, an external operation member or memory rewriting means may be used so that the change period to add the number of transmissions can be set again with respect to the change period setting means 11.

Further, while in the above description described ST changeover, the present invention is not limited to this, and any sudden change of time information can be dealt with.

Figure 5:
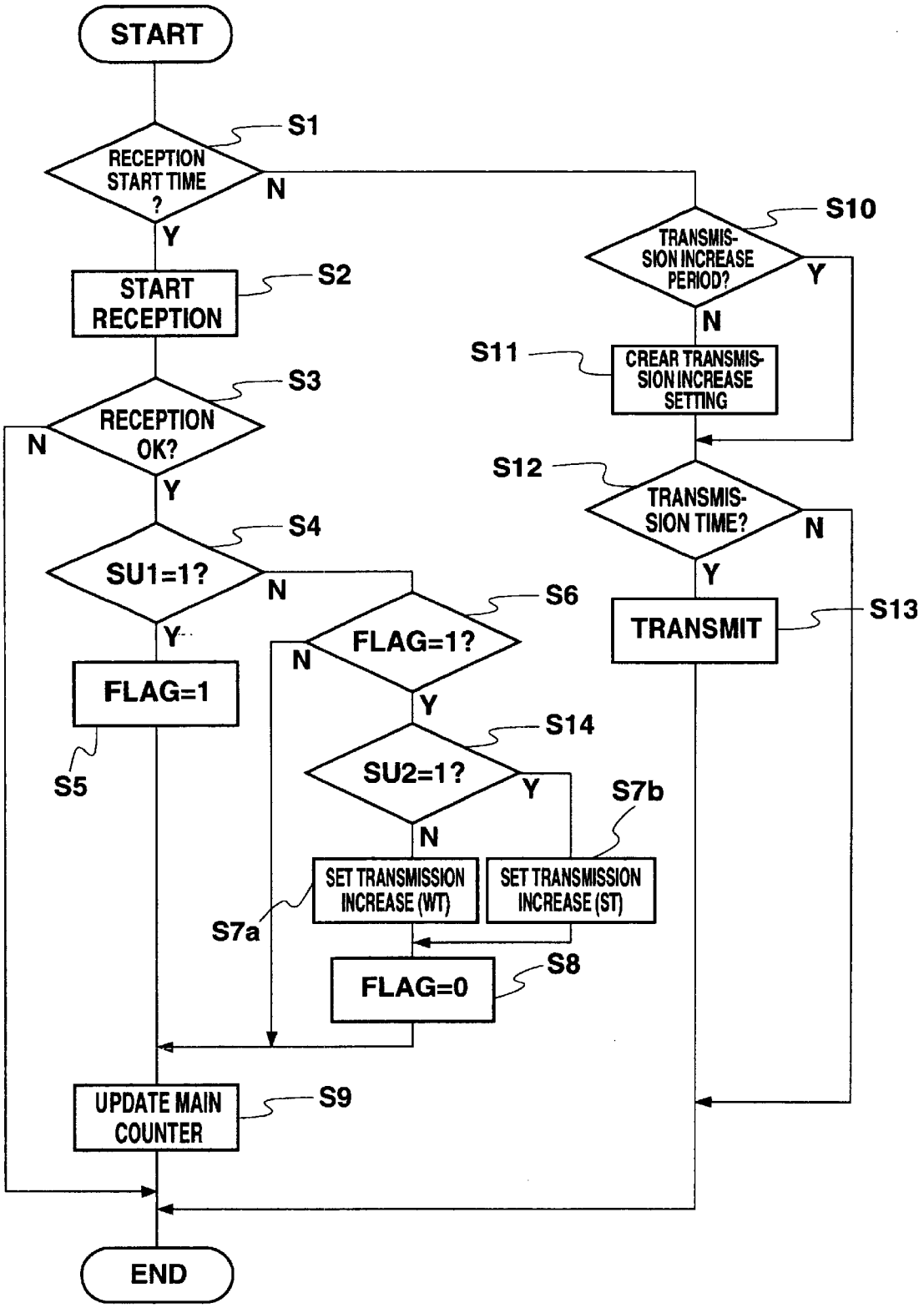
FIG. 5 is a flowchart showing one example of the operation of a second embodiment of the present invention.

FIG. 5 is a flowchart showing a second embodiment of the present invention, and shows the embodiment constituted by modifying a part of the first embodiment of FIG. 2. FIG. 5 will be described below. In FIG. 5 the initially set values, ST/WT changeover time, and other conditions are similar to those of the first embodiment of FIG. 2 and the same step numerals as those of FIG. 2 denote the similar processing.

Because the processing with no advance notice information is similar to the processing in FIG. 2, the description thereof will not be repeated. The changeover to ST from WT will next be described. When the transmission data starts to output the ST advance notice information (SU1=1) at 3:00, reception is performed at the reception time of the repeating installation. When the reception is OK at S3, the process continues to S4, in which SU1 is one. Therefore, at S5 FLAG is set to one, and at S9 the main counter is updated. For reception in the advance notice period, such processing is repeatedly performed. Since the transmission is similar to the transmission with no advance notice information as described with reference to FIG. 2, the description is not repeated here.

Figure 6:
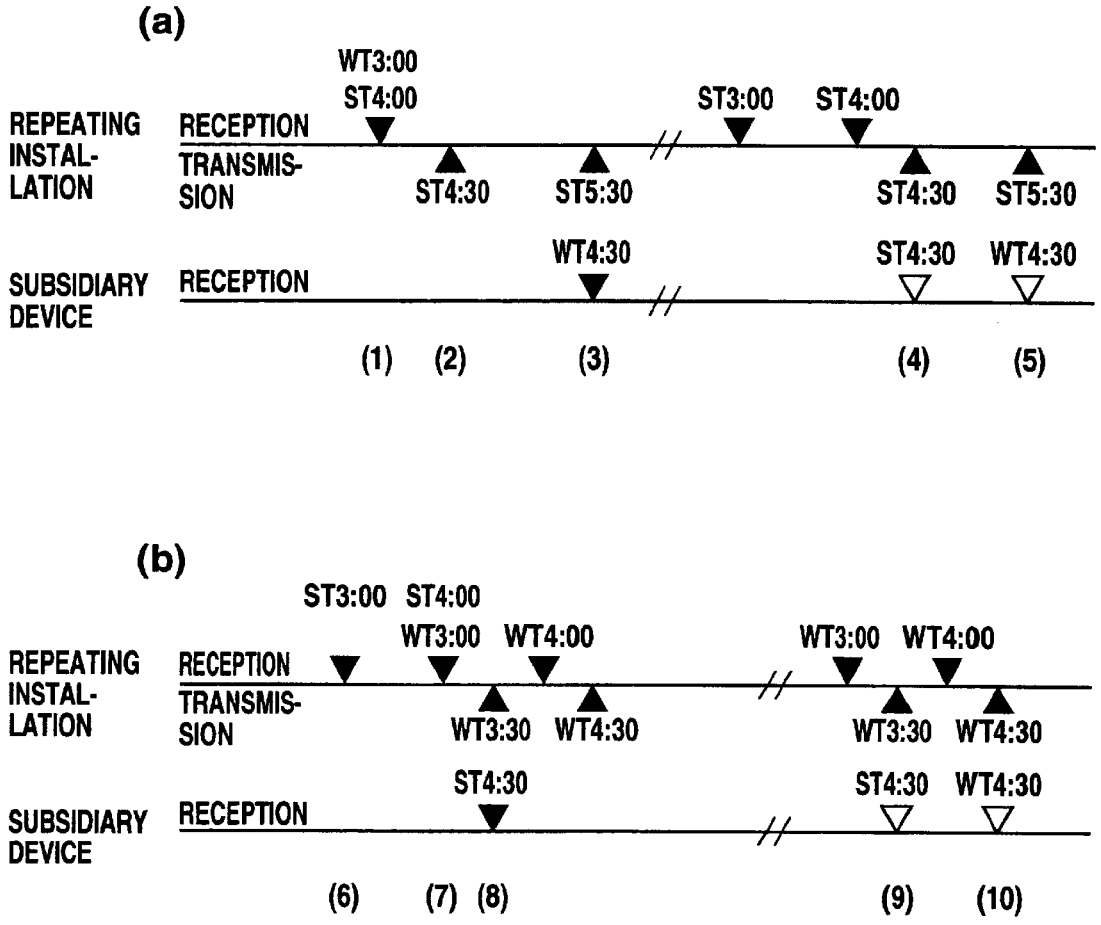
FIGS. 6(*a*) and 6(*b*) are time chart showing one example of the operation of the second embodiment.

Several days later, the advance notice is canceled and the time is changed to ST at 3:00. The changeover day will be described below. At 3:00 the process continues through S1, S2, S3. When the reception is OK, the process continues to S4, and the SU1 state is confirmed. At this time, SU1 is cleared, SU2 is set to one, and the process continues to S6. Since at S6 FLAG is still one (i.e., this indicates that the advance notice is changed to ST with this reception), the process continues to S14 in which the state of SU2 is confirmed. Here, since the time is already changed to ST (SU2=1), the process continues to S7*b*. At S7*b*, the additional transmission is set. (In the example illustrating this embodiment, the additional transmission is set to 5:30 for seven days.) Subsequently, at S8 FLAG is cleared, and at S9 the main counter is updated to ST, that is, advanced by one hour. (FIG. 6A is a time chart showing the changeover to ST from WT, and the above-described corresponds to time (1).) When time elapses until 4:30, the process continues to S10 from S1 to check the change period, and it is judged at S12 whether it is the transmission time. Because the value indicates it is time for transmission, transmission is started at S13. However, since the subsidiary equipment is not synchronized with the transmission, reception cannot be performed (time (2) in FIG. 6A). When time elapses until 5:30, the process continues to S10 from S1. Because it is a transmission increase period and the transmission is performed at 5:30, the process continues to S12 (time (3) in FIG. 6A). Here, the subsidiary equipment performs reception. When the reception is OK, the time is updated to the correct time, that is, ST. Thereafter, the repeating installation performs transmission, and the subsidiary equipment performs reception at ST 4:30 (time (4) in FIG. 6A). When the reception is not OK, the repeating installation performs transmission and the subsidiary device performs reception at timing (5) of FIG. 6A. The above-described operation is performed until the counter 12*a* reaches zero. The counter 12*a* of zero indicates that the transmission increase period ends, and the process continues to S11 after the judgment of S10 so that the increased/set transmission time (5:30) is cleared. In this case, even if the time of the repeating installation and subsidiary equipment deviates, but when the reception of the subsidiary equipment is successful in the period in which the transmission is added, the subsidiary equipment can obtain the correct time from the repeating installation.

A changeover to WT from ST will next be described. It is assumed in ST that SU2 is one and the transmission data from the base station outputs ST advance notice information (SU1=1).

3:00 is the reception time of the repeating installation, and the process continues to S2 from S1 to perform reception. When the reception is OK at S3, SU1 is one at S4 in this case, FLAG is set to one at S5, and the main counter is updated at S9. Moreover, the transmission is performed at 4:30, and such processing is repeatedly performed in the advance notice period. Several days later, the advance notice is canceled and the time is changed to WT. The changeover day will be described below. At ST 3:00 the process continues through S1, S2, S3. When the reception is OK, the process continues to S4, and the state of SU1 is confirmed. Since SU1 is still one at this time, the process continues to S9 via S5 (time (6) of FIG. 6B). When time elapses until ST 4:00, the repeating installation starts reception and the process continues through S1, S2, S3. When the reception is OK at S3, the process continues to S4. At this time ST is changed to WT, the main counter of the repeating installation is updated to WT, simultaneously the advance notice ends, and SU1 also turns to zero. Specifically, the process continues to S6 from S4, FLAG is still one at S6 (this indicates that the advance notice is changed to WT with this reception), and the process continues to S14 to confirm the state of SU2. Since the time is already changed to WT (SU2=0), the process continues to S7*a*. The additional transmission is set at S7*a* (in the present embodiment the additional transmission is performed at 3:30 for seven days). Subsequently, at S8 FLAG is cleared, and at S9 the main counter is updated to WT, that is, put back by one hour (time (7) of FIG. 6B). When time elapses until 3:30, the process continues to S10 from S1, and it is checked whether it is a transmission increase period. Since it is the transmission increase period, it is judged at S12 whether it is transmission time. Since it is the transmission time, at S13 the transmission is started. In this case, the subsidiary equipment is still in ST, the reception time 4:30 of the subsidiary equipment is recognized, and the reception is started (time (8) of FIG. 6B). Here, when the reception of the subsidiary equipment is successful, the time is updated to WT. Thereafter, at WT 4:30 the repeating installation performs 25. transmission and the subsidiary equipment performs reception (time (10) of FIG. 6B). When the reception is not OK, the repeating installation performs transmission, and the subsidiary equipment performs reception at timing (9) of FIG. 6B. This is similar to the operation for the changeover to ST from WT described above.

As described above, by judging whether the changeover to ST or WT is performed, it can be judged whether the transmission is added to the transmission time as the initial value in the direction of +one hour or conversely in the direction of −one hour. This configuration can realize a reduction in the number of transmissions to the absolute minimum. A large power consumption required in the transmitting operation is avoided. Additionally, even if a sudden time change occurs, the transmission timing of the repeating installation is effectively allowed to agree with the reception timing of the subsidiary equipment in this constitution.

Moreover, since the means for clearing the transmission time held as the initial value in S7*a*, S7*b* in FIG. 5 during the transmission increase period is disposed, the number of transmissions can further be decreased. In such a case, when the time of the repeating installation agrees with that of the subsidiary equipment, thereafter the subsidiary equipment cannot perform reception with respect to the transmission of the repeating installation during the increase setting period. However, when the setting period ends, the timing of the repeating installation agrees with the reception timing of the subsidiary equipment again.

In the above-described embodiments, the changeover to ST/WT is judged by the advance notice bit included in the time information, but the changeover time may be recognized based on the calendar information held by the main counter 8.

Moreover, by comparing the received time with the time immediately before the reception, and judging that there is a change in the time information when there is a fluctuation equal to or more than a predetermined value, the transmission time may be changed based on the fluctuation value.

Furthermore, according to the present invention, the number of transmissions, transmission frequency change period, and transmission time at the time of reception of the repeating installation are changed in accordance with the change of the leap second correction information and ST changeover advance notice information. Even when the reception timing of the subsidiary equipment deviates from the transmission timing of the repeating installation by the occurrence of a sudden time change, the time information of the subsidiary equipment can be updated, and other effects can be obtained. As described above, according to the present invention, in the repeating installation for receiving a standard radio signal and transmitting the time information and advance notice information to the subsidiary equipment, even when a sudden time change occurs, by newly setting the transmission start time, a repeating installation which can perform transmission in accordance with the reception timing of a subsidiary device can be realized.

Figure 7:
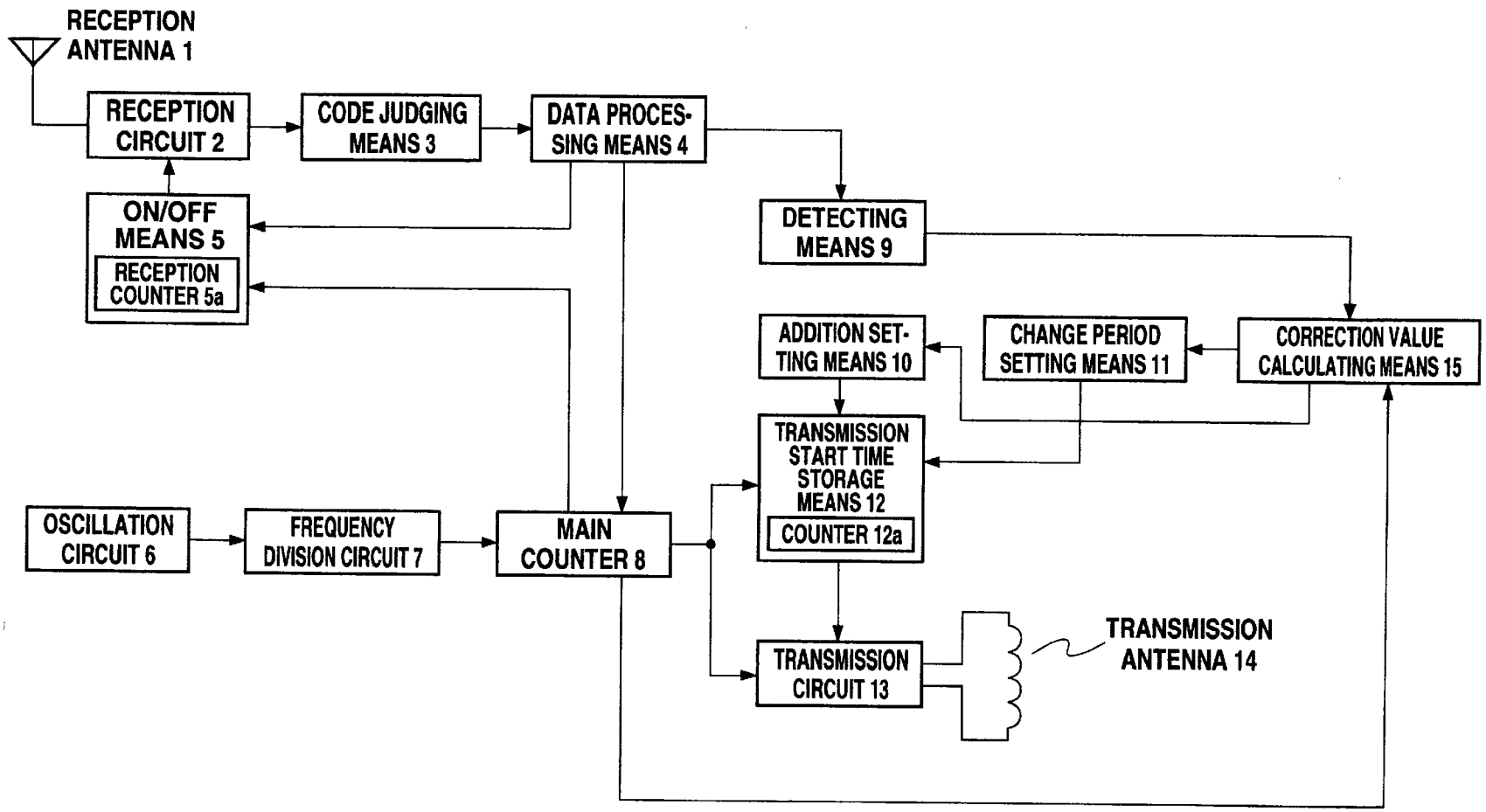
FIG. 7 is a system block diagram showing a third embodiment of the present invention.

A third embodiment of the present invention will next be described with reference to FIG. 7. In FIG. 7, the same components as those of FIG. 1 are denoted by the same numerals, and the description thereof is omitted.

Numeral 15 denotes a correction value calculating means for inputting the time data held by the main counter 8. When the detecting means 9 detects the advance notice signal, the time data outputs the predetermined value to the addition setting means 10 and the detection signal to the change period setting means 11.

The operation will next be described. Since the operation is basically the same as that of FIG. 1, only different respects will be described.

First the correction value calculating means 15 operates by the output of the detecting means 9. In the correction value calculating means 15, while the advance notice signal is output, the change of the main counter 8 is detected. When the change value is equal to or more than the predetermined value, the change value is output to the addition setting means 10. Moreover, the detection signal indicating the detection of the change equal to or more than the predetermined value is outputted to the change period setting means 11.

The addition setting means 10 adds/sets the transmission time to a time deviating by the same amount as the change data amount based on the change data of the correction value calculating means, and stores the transmission time in the transmission start time storage means 12. Moreover, the change period setting means 11 sets the period for addition, and stores the period in the counter 12*a*.

Figure 8:
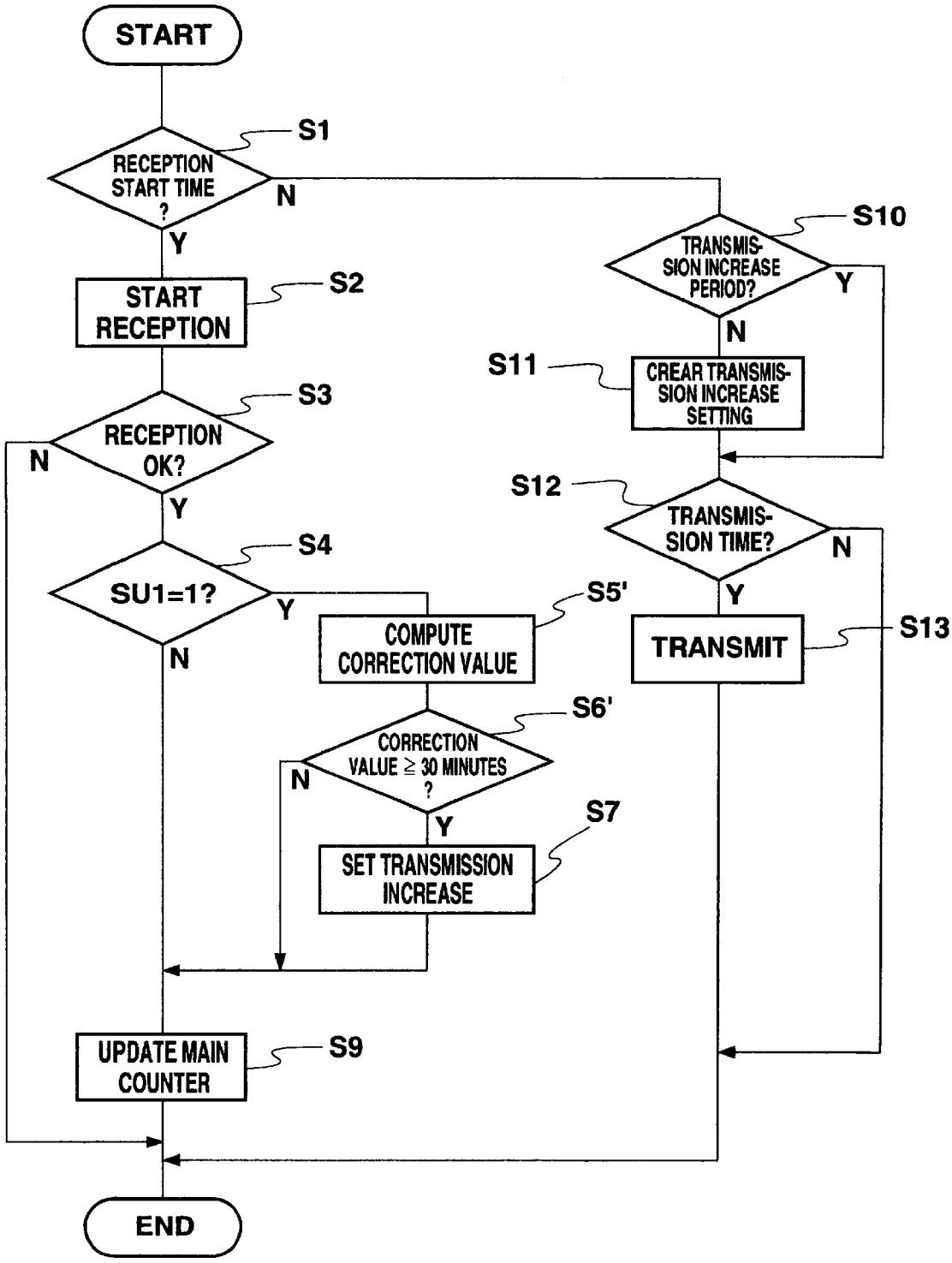
FIG. 8 is a flowchart showing the third embodiment of the present invention.

The operation of the third embodiment will next be described in more detail with reference to FIG. 8. FIG. 8 is a flowchart showing the third embodiment of the present invention. Processes similar to those shown in FIG. 2 are denoted by the same step numerals, and their description is not repeated.

The processing when there is no advance notice signal is substantially similar to that of FIG. 2, but, in the present embodiment only 0, 1 of the advance notice bit SU1 may be judged, and "FLAG=1" of S5 is omitted.

First the changeover to WT from ST will be described. Because the advance notice bit SU1 increases several days before the changeover, Y is obtained in S4, thereby advancing to S5'. Here a difference between the received time and the time held by the repeating installation, that is, a correction value is obtained. Subsequently, it is then judged at S6' whether the obtained correction value is equal to or more than the predetermined value (30 minutes in this example). Because the advance notice bit SU1 is freshly output, and WT is still set, N is obtained, thereby advancing the process to S9.

This state continues for a while, but on the day of the changeover of ST/WT, the received time differs from the time held by the main counter 8 by one hour, Y is obtained in S6', thereby advancing to S7. Here the additional transmission is set. In the present example, the additional transmission is performed at 3:30 and 5:30, that is, two times of 4:30 plus/minus the correction value obtained in S5'. The other aspects are the same as in FIG. 2. Subsequently, the main counter is updated in S9.

Because the transmission is similar to that of FIG. 2, description thereof will not be repeated.

As described above, in the third embodiment, since the additional time is set by the difference between the received time and the time held by the main counter 8, the case in which the time setting is changed not by one hour can be handled, and there can be provided a repeating installation which can broadly be applied.

Figure 9:
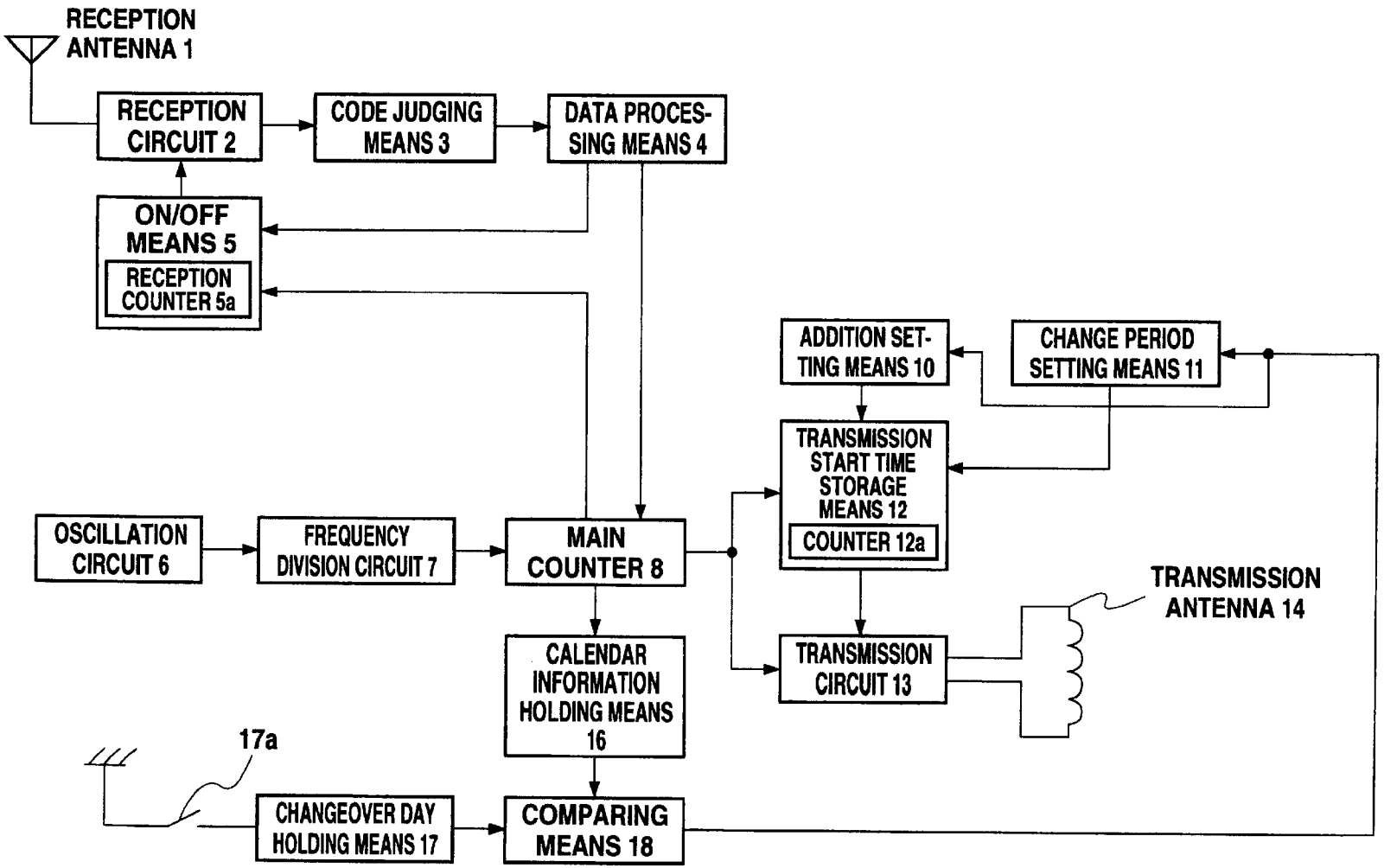
FIG. 9 is a system block diagram showing a fourth embodiment of the present invention.

A fourth embodiment of the present invention will next be described. FIG. 9 is a block diagram showing the fourth embodiment, components already described for FIG. 1 are denoted by the same numeral, and their description is not repeated here. In the present embodiment, the detecting means 9 is omitted, and there are newly provided changeover day holding means 17 for holding the ST/WT changeover day and calendar information holding means 16 for holding the present calendar information. There is also newly provided comparing means 18 for comparing these held contents. Numeral 17*a* denotes switch means for setting the content of the changeover day holding means 17, by which the user sets the changeover day.

The operation of the fourth embodiment will next be described. The basic operation is similar to that of FIG. 1.

The time data received by the reception circuit 2 is transmitted to the main counter 8 via the data processing means 4, and the calendar information held by the calendar information holding means 16 is updated. Moreover, the user sets the changeover day to summer time, which, in many parts of Europe, is performed on the last Sunday of March, with the summer time ending on the last Saturday of September. When these two held days agree each other, the comparing means 18 outputs a correspondence signal. The addition setting means 10 and the change period setting means 11 add the transmission time only for the predetermined period based on the correspondence signal. The time and number to be added are similar to those in the first embodiment.

The same applies to the changeover to winter time from summer time. When the user performs the setting on the changeover day holding means 17, the similar operation is performed.

As described above, in the fourth embodiment, the transmission time and the number of transmissions can be changed without disposing the detecting means 9.

The system including the subsidiary equipment of the present invention will next be described. In the following description, a repeater has a function simpler than that shown in FIG. 1. The function comprises performing the receiving operation at the positive minute every hour, and performing the transmitting operation only once at 4:30 every day. Moreover, the data processing means 4 also outputs data such as the advance notice bit to the main counter 8, and the main counter 8 updates and holds the data such as the advance notice bit in built-in storage means (not shown) and outputs the data such as the advance notice bit in the latest reception together with the time data to the transmission circuit 13.

Figure 10:
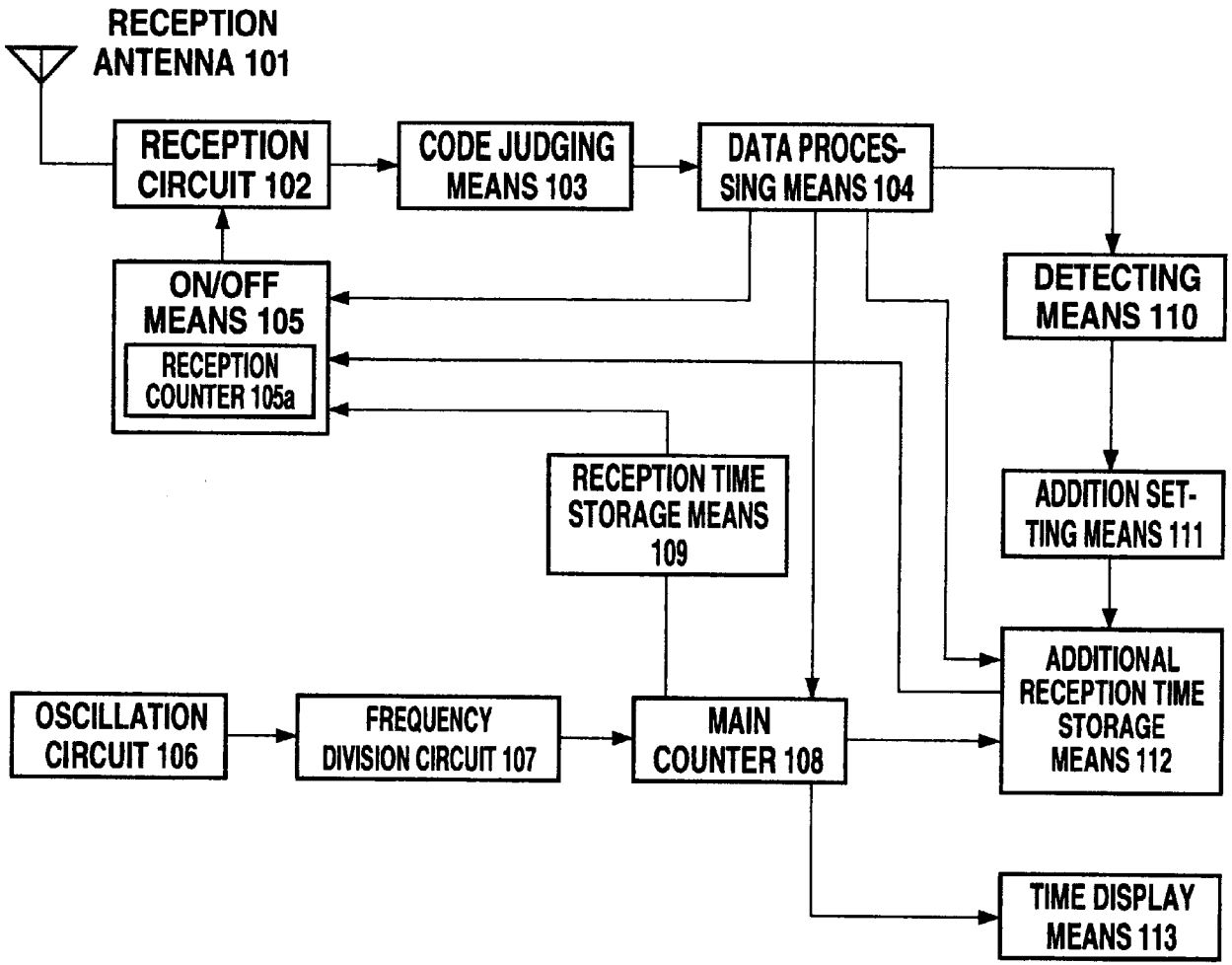
FIG. 10 is a system block diagram showing a fifth embodiment of the present invention.

FIG. 10 is a circuit block diagram showing a subsidiary device of a fifth embodiment of the present invention. In FIG. 10, numeral 101 denotes an antenna for receiving the signal output from the transmission antenna 14 of the repeating installation, 102 denotes a reception circuit for performing amplification, filter processing, and wave detection of the signal received by the reception antenna 101, 103 denotes code judging means for judging 0, 1, P from a demodulated waveform of the reception circuit 102, 104 denotes data processing means for processing the code outputted from the code judging means 103 to provide time information or the like, 105 denotes ON/OFF means for turning on the reception circuit 102 based on a reception command signal from reception time storage means 109 or additional reception time storage means 112 described later, and 105*a* denotes a reception counter for counting while reception is performed. Numeral 106 denotes an oscillation circuit, 107 denotes a frequency division circuit, and 108 denotes a main counter for holding time. Numeral 109 denotes reception time storage means for storing an ordinary reception time and outputting the reception command signal when the time of the main counter 108 agrees with the stored time, 110 denotes detecting means for detecting the advance notice content outputted from the data processing means 104, 111 denotes addition setting means for adding the number of receptions based on the detection result of the detecting means 110, and 112 denotes additional reception time storage means for storing the additional reception time set by the addition setting means 111. Numeral 113 denotes time display means for displaying the time based on the time information held by the main counter 108.

The operation of the subsidiary equipment of the fifth embodiment in the present invention will next be described.

The reception time storage means 109 outputs the reception command signal to the ON/OFF means 105 when the stored reception time agrees with the time held by the main counter 108. The ON/OFF means 105 operates the reception circuit 102 by this signal. Therefore, the reception circuit 102 starts reception, and performs amplification, frequency filter processing, and wave detection of the radio signal obtained via the antenna 101, and the wave detection result is output from this reception circuit 102. From this wave detection result the code judging means 103 judges each code 0, 1, P, and the data processing means 104 performs the data processing to generate the time data, calendar data, and advance notice information. Here, the data processing means 104 outputs the obtained data to the main counter 108 if the data is not non-present data, updates the value of the main counter, and simultaneously outputs a reception end signal to the ON/OFF means 105. For the present data and other unrecognizable data, the value of the main counter 108 is not updated, and the reception is continued to obtain the next data. When the counter 105*a* for counting the reception time in the ON/OFF means 105 exceeds a certain constant value, the reception ends. If no recognizable data can be obtained, the data of the main counter 108 is not updated. When the correct data can be obtained, the data of the main counter 108 is updated as described above.

Here when the advance notice information is present in the received data, the detecting means 110 detects the information and outputs the information to the addition setting means 111. Therefore, the addition setting means 111 adds/sets the reception time to the ordinary reception time plus/minus one hour, and stores the setting into the additional reception time storage means 112. Therefore, when there is advance notice information, the receiving operation is performed at the ordinary reception time and the additional reception time. For the reception of the additional reception time only, when the reception is successful, the data processing means 104 outputs a reset signal to the additional reception time storage means 112. Therefore, when the reception is successful even once at the added time, the ordinary reception state is returned.

Figure 11:
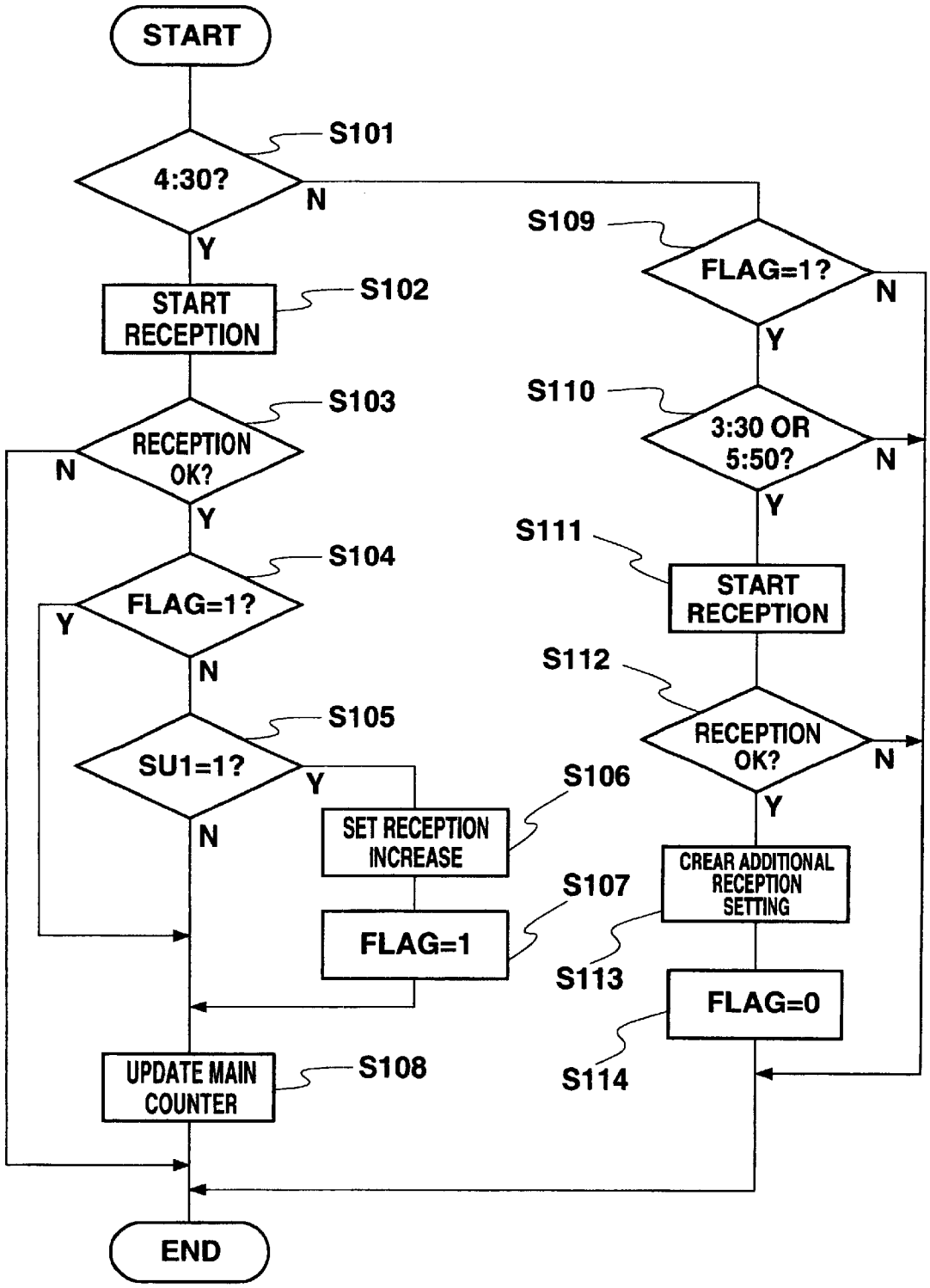
FIG. 11 is a flowchart showing one example of the operation of a subsidiary equipment according to the fifth embodiment of the present invention.
Figure 12:
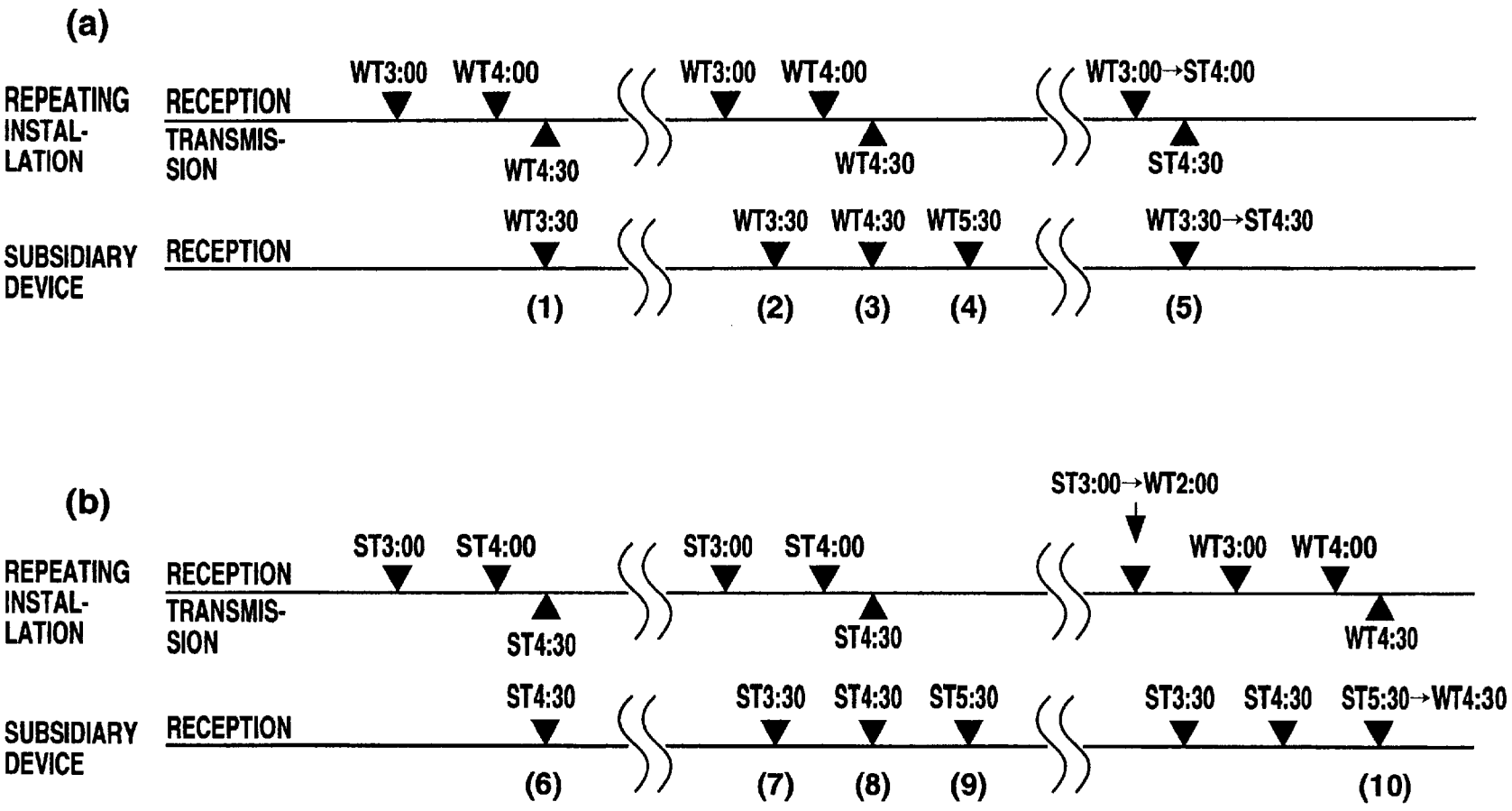
FIGS. 12(*a*) and 12(*b*) are time charts showing one example of the operation of the fifth embodiment of the present invention.

The above-described operation will next be described in more detail with reference to FIGS. 11 and 12. FIG. 11 is a flowchart showing the operation, and FIG. 12 is a time chart.

Additionally, in the initial setting FLAG is set to zero. When it is a reception start time (4:30) at S101, reception is performed at S102. Here, when the reception is successful, and FLAG and advance notice bit SU1 are both other than 1, the process continues to S108 to update the main counter 108 (time (1) of FIG. 12A).

When the advance notice bit SU1 turns to 1 several days before the changeover to ST from WT, Y is obtained at S105, thereby advancing to S106. Here the additional reception is set. (In the present embodiment the additional reception is performed at two times of 4:30 plus/minus one hour, that is, 3:30 and 5:30. Therefore, 3:30 and 5:30 are stored in the additional reception time storage means 112.) Subsequently, FLAG is set to 1 at S107, and the main counter 108 is updated at S108.

At 3:30 the next day the process continues to S109 via S101. Here since FLAG is 1, the process advances to S110. Y is obtained at S110, and the process advances to S111 to start reception. However, because the present time is not a transmission time, the repeater cannot perform reception (time (2) of FIG. 12A). At 4:30 S101 obtains Y to perform reception. As 4:30 is the transmission time of the repeater, reception is performed (time (3) of FIG. 12A), thereby advancing to S104. Since FFLAG is 1, S104 obtains Y and the main counter 108 is updated at S108.

At 5:30 the process advances to S111 in a similar manner as 3:30, but reception cannot be performed here (time (4) of FIG. 12A). This state continues for six days at maximum. However, when the repeater receives ST, and the transmission time is advanced by one hour, reception can be performed at the additional reception time 3:30, and the time of the subsidiary equipment is corrected to provide ST 4:30 (time (5) of FIG. 12A). When the reception is successful, S112 advances to Y, and the additional reception setting is cleared at S113. Moreover, FLAG is also set to 0, and the additional reception ends.

The changeover to WT from ST will next be described. The basic operation is the same as that of the changeover to ST from WT. Therefore, the operation will be described with reference to the time chart of FIG. 12B. As shown in Table 1 SU1 is zero during ST period. At this time since the repeater and the subsidiary equipment both have ST, the subsidiary equipment can receive the transmission data of the repeater at ST 4:30 (time (6) of FIG. 12B).

Six days before ST ends, the value for bit SU1 becomes 1. Therefore, the additional reception time is set to 3:30, 5:30. Even here the reception cannot be performed at the added 3:30 (time (7) of FIG. 12B), 5:30 (time (9) of FIG. 12B) until the changeover, and the reception can be performed only at 4:30 (time (8) of FIG. 12B).

After the changeover to WT, the reception at the added 5:30 means the transmission time of the repeating installation (time (10) of FIG. 12B). Therefore, the subsidiary equipment succeeds in reception, and is corrected to provide WT 4:30.

Figure 13:
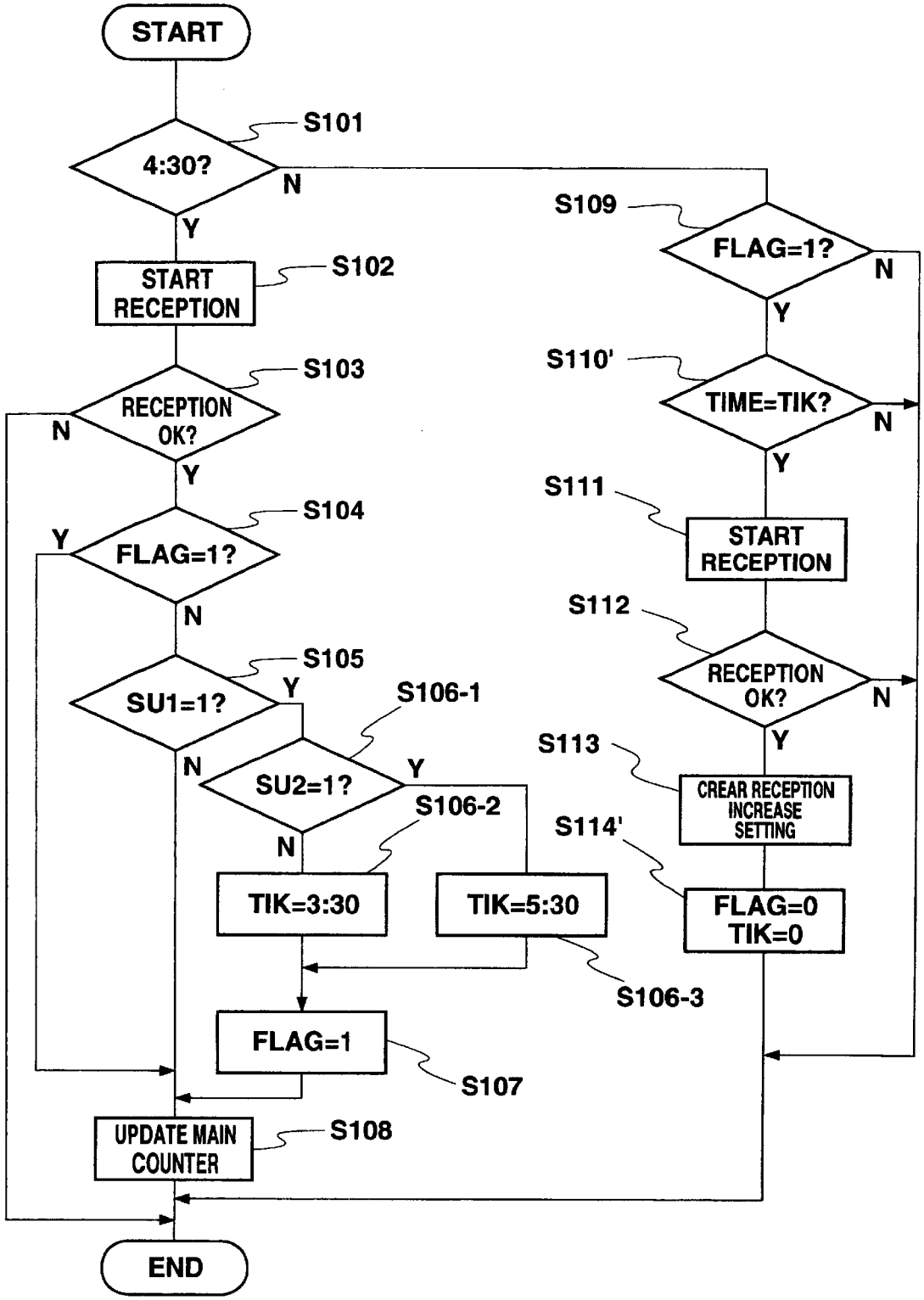
FIG. 13 is a flowchart showing one example of the operation of the subsidiary equipment according to a sixth embodiment of the present invention.
Figure 14:
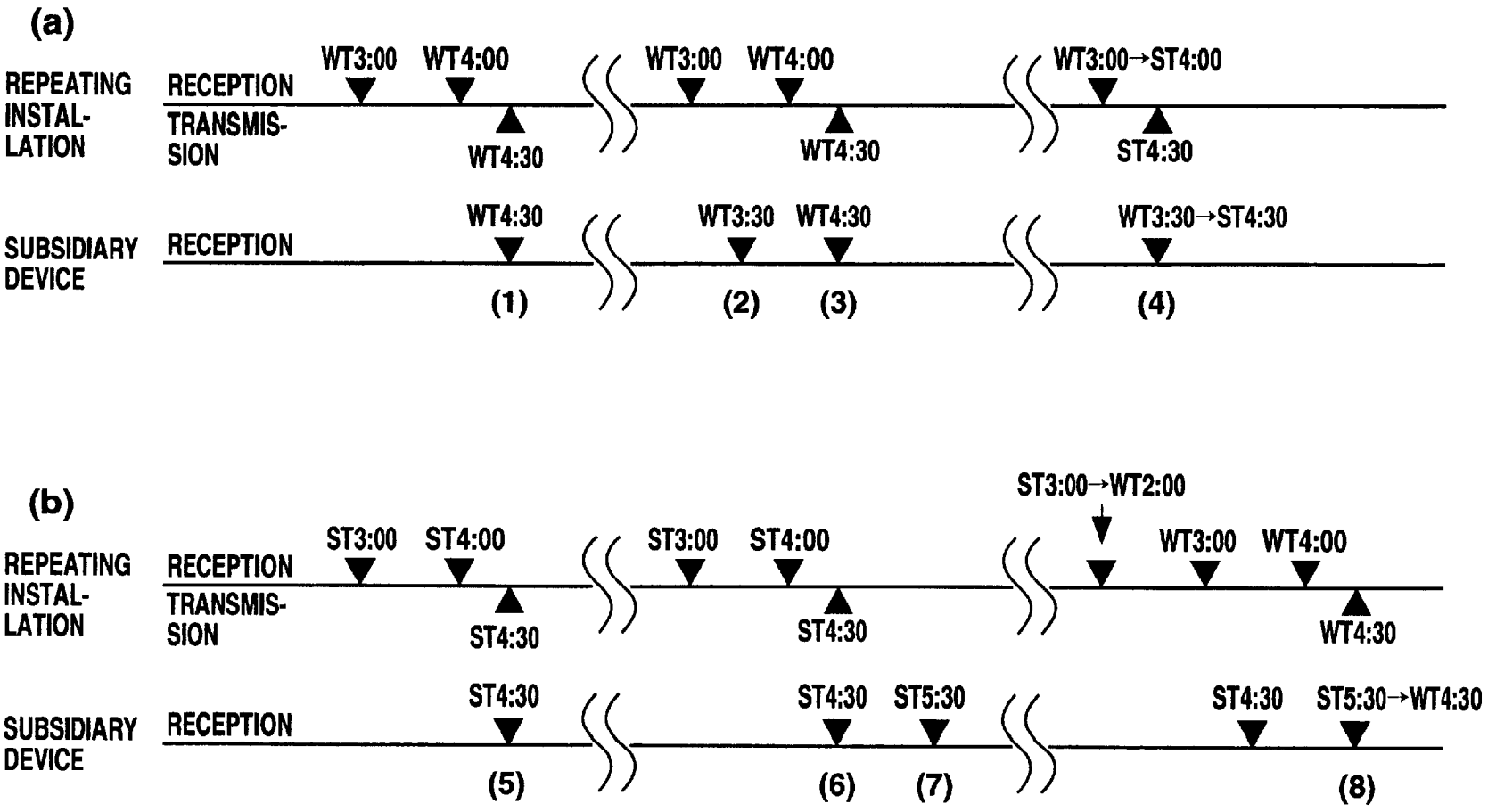
FIGS. 14(*a*) and 14(*b*) and time chart showing one example of the operation of the sixth embodiment of the present invention.

The control method when only the SU1 is detected has been described above. Therefore, when SU1 is detected, by setting the reception time one hour before and after as predetermined, both the shift to ST from WT and the shift to WT from ST can be handled. However, in either case, reception time is wasted. To improve this, the bit of SU2 may be detected. This detecting method will be described as a sixth embodiment with reference to a flowchart of FIG. 13 and a time chart of FIG. 14. In FIG. 13 an algebraic number TIK indicative of the additional reception time is set to 0 in the initial setting.

In FIG. 13 the same step as that of FIG. 11 is denoted by the same numeral and the description thereof is omitted. First, the shift to ST from WT will be described.

The reception during WT is performed in a similar manner as above (time (1) of FIG. 14A). Here SU1 bit turns to 1 six days before the ST changeover, and the process advances to S106-1 from S105. Since SU2 is zero during the WT period, the process advances to S106-2 to set TIK to 3:30. At 3:30 on the next day the process advances to S109 from S101 and FLAG turns to 1, thereby advancing to S110'. Because 3:30 is set to TIK, the receiving operation is performed here (S111), but the repeater still having WT does not perform reception (time (2) of FIG. 14A). Therefore, S112 obtains N, thereby ending the process. Next at 4:30 the process advances to S102 from S101 and the ordinary reception is performed (time (3) of FIG. 14A). This state continues for a while, but when the changeover to ST from WT is performed to obtain ST time of the repeater, reception is performed at 3:30 in the subsidiary equipment, and the time of the subsidiary equipment is corrected to provide ST 4:30 (time (4) of FIG. 14A). Therefore, S112 obtains Y and the reception addition setting is cleared. Moreover, FLAG and TIK are also returned to the initial state of 0.

The changeover to WT from ST will next be described. The reception during ST is similar to the reception in the ordinary state (time (5) of FIG. 14B). Here the SU1 bit turns to 1 six days before the changeover to WT, and the process advances to S106-1 from S105. Since SU2 is 1 during the ST period, the process advances to S106-3 to set TIK to 5:30. Next at 5:30 the process advances to S109 from S101 and FLAG is 1 thereby advancing to S110'. Since TIK is set to 5:30, the receiving operation is performed here (S111), but the repeater still having ST does not perform reception (time (7) of FIG. 14B). Therefore S112 obtains N and ends. At 4:30 on the next day, the process advances to S102 from S101 and the ordinary reception is performed (time (6) of FIG. 14B). The time (6) (7) of FIG. 14B is repeated for a while, but the changeover to WT from ST is performed to obtain time WT of the repeater, reception is performed at 5:30 of the subsidiary equipment (S111 of FIG. 13), and the time of the subsidiary equipment is corrected to provide WT 4:30 (time (8) of FIG. 14B). Therefore, S112 obtains Y and the reception addition setting is cleared. Moreover, FLAG and TIK are both returned to the initial state of 0.

With this configuration, wasted reception time can be reduced. This method differs from the method in which the reception time is added before and after the ordinary reception time.

In the above-described example, the added reception is continued until successful, but the present invention is not limited in this way. For example, when reception cannot be performed even after the elapse of the predetermined period, the ordinary reception cycle may automatically be returned. Then, even if an unexpected situation occurs, the wasteful receptions can be reduced.

A seventh embodiment of the present invention will next be described in which the detecting means 110 is not disposed. In this method, even when the bits SU1, SU2 are not output to the repeating installation, similar effect can be obtained.

Figure 15:
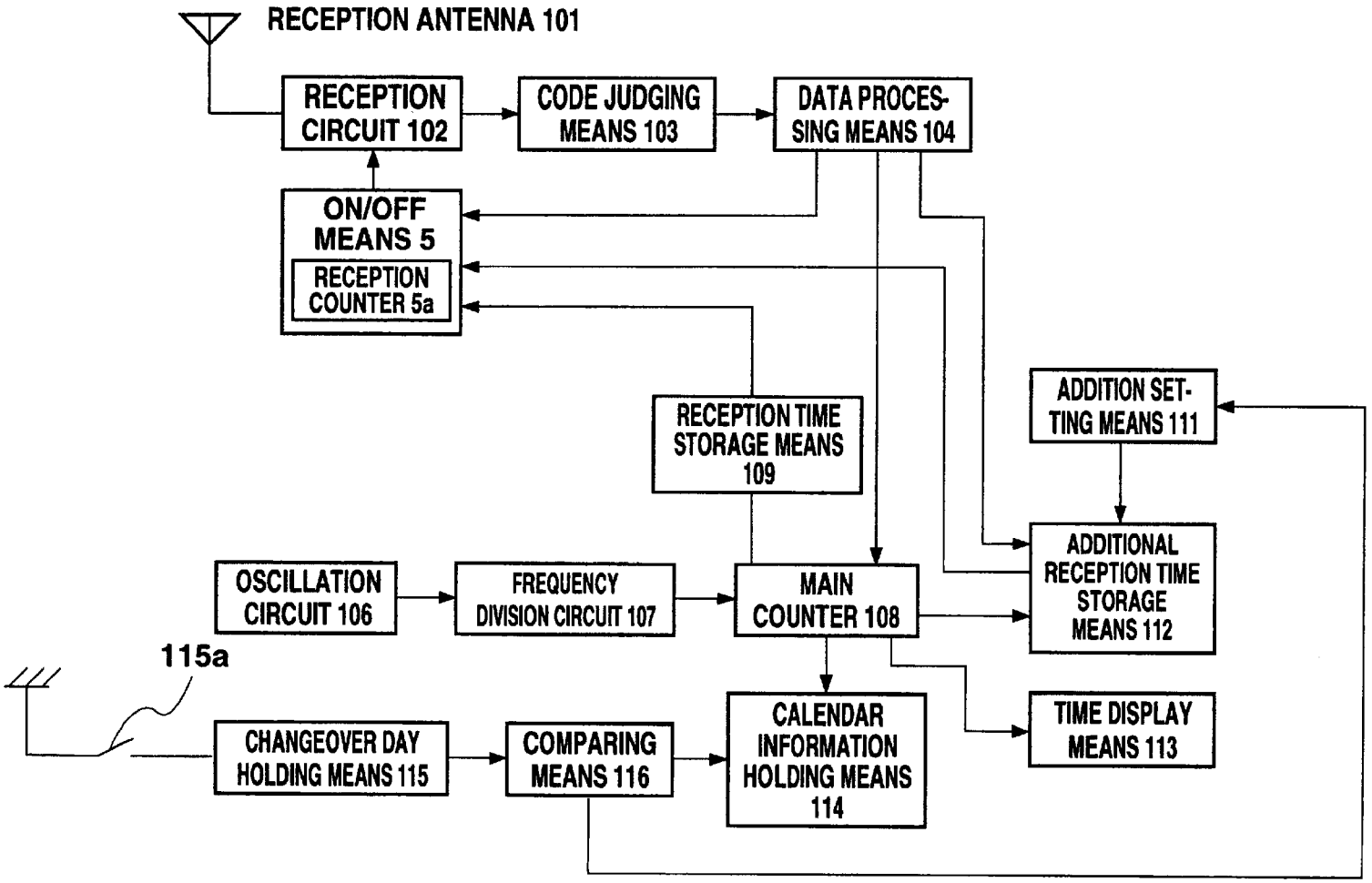
FIG. 15 is a system block diagram of the subsidiary equipment according to a seventh embodiment of the present invention.

FIG. 15 is a circuit block diagram showing the constitution of the subsidiary equipment of the seventh embodiment, the same constitution as that of FIG. 10 is denoted with the same numerals and the description thereof is not repeated.

Numeral 114 denotes calendar information holding means holding calendar information, 115 denotes changeover day holding means for holding the changeover day to summer time or the like, 116 denotes comparing means for comparing the present calendar information held by the calendar information holding means 114 and the changeover day held by the changeover day holding means 115, and **115*a*** denotes switch means for setting the held content of the changeover day holding means.

The operation of the present embodiment will now be described. The basic operation is similar to that shown in FIG. 10.

The time data received by the reception circuit 102 is sent to the main counter 108 via the data processing means 104, and the calendar information held by the calendar information holding means 114 is updated. Moreover, the user presets the changeover day to summer time notified via information media into the changeover day holding means 115 using the switch **115*a*. When these two values agree with each other, the comparing means 116 outputs the correspondence signal. The addition setting means 111 adds/sets the ordinary reception time plus/minus one hour based on the correspondence signal, and stores the reception time into the additional reception time storage means 112. For the reception of the additional reception time only, when the reception is successful, the data processing means 104 outputs the reset signal to the additional reception time storage means 112**. Therefore, when the reception is successful even once at the added time, the ordinary reception state is returned.

This also applies to the changeover to WT from ST. When the user performs the setting on the changeover day holding means 116, the similar operation is performed.

In the seventh embodiment described above, the transmission time or the number of transmissions can be changed without disposing the detecting means 110.

Moreover, the ordinary time plus/minus one hour is used as the additional reception time, but the present invention is not limited to this. For example, a method of adding one hour either before or after can be used in accordance with the difference of the changeover day of ST/WT.

In the repeating installation according to the first to fourth embodiments, transmission is performed at the time deviating from the predetermined standard time by the change time in response to the output of the change recognizing means. Therefore, the time can be adjusted to the predetermined reception time of the time display as the subsidiary equipment, and the changeover to the summer time can automatically be handled.

Moreover, also in the fifth to seventh embodiments in which the subsidiary device side is provided with the change recognizing means, the reception time of the subsidiary equipment can be adjusted to the transmission time of the repeater, and the changeover to the summer time can automatically be handled.

An eighth embodiment of the present invention will next be described.

Figure 16:
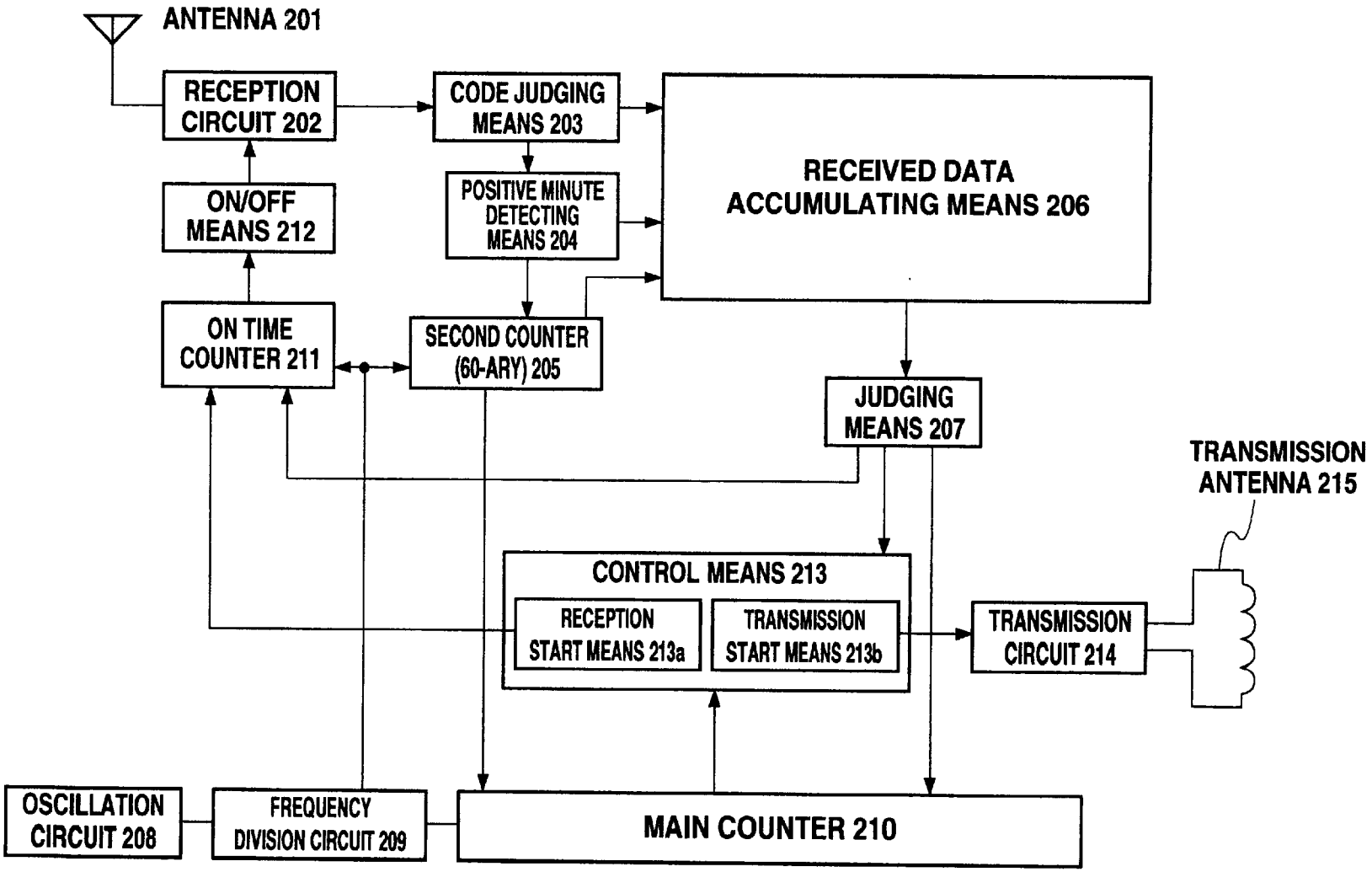
FIG. 16 is a block diagram showing the constitution of a time information repeating installation according to an eighth embodiment of the present invention.

FIG. 16 is a block diagram showing the constitution of the time information repeating installation in the eighth embodiment of the present invention. In the present embodiment the standard radio signal will be described as the signal including the standard time information.

An oscillation circuit 208, a frequency division circuit 209, and a main counter 210 shown in the lower part of FIG. 16 constitute a clock. The oscillation circuit 208 is usually a crystal oscillation circuit with a crystal vibrator, with an oscillation frequency such as about 32 kHz. The frequency division circuit 209 divides the output of the oscillation circuit 208, for example, to 1 Hz as a second signal. The main counter 210 counts the output of the frequency division circuit 209 to hold the time information, details thereof are omitted, but the counter is constituted of second, minute, and hour counters, further a calendar counter, and the like. As omitted from FIG. 16, additionally a time display section, time setting means for an external operation, and the like are attached.

In FIG. 16, the section other than the above-described clock components forms the constitution for performing the reception of standard radio signals and the transmission of time data. The standard radio signal is received by an antenna 201, amplified and modulated by a reception circuit 202, and outputted as a signal with a predetermined format including time and calendar data. As described above, to reduce power consumption, the reception is not always performed, but is only periodically performed at a predetermined interval. The reception circuit 202 operates only when it is instructed to perform reception by ON/OFF means 212. The ON/OFF means 212 is further controlled by an ON time counter 211 as described later.

The data signal output from the reception circuit 202 is transmitted to code judging means 203. As described above, the data signal is included by coding the data of one bit per second to 0, 1, P, and the like by a pulse width, and the code judging means 203 distinguishes the code represented by the data of each second and transmits the code to received data accumulating means 206. Moreover, the code judging means 203 also outputs the code to positive minute detecting means 204. As described above, since P code arrives continuously for two seconds in the positive minute, the positive minute detecting means 204 monitors this and transmits the detected positive minutes to the received data accumulating means 206.

The received data accumulating means 206 is a storage means for dividing the input series data to time data of hour, minute, and second, or calendar data to store the data. The received data accumulating means 206 needs to take in the data in synchronization with the proceeding of each frame, and is therefore provided with a second counter 205. This is a 60-ary counter, starts operating on receiving the positive minute detection signal from the positive minute detecting means 204, counts a 1 Hz signal from the frequency division circuit 209, and transmits the number of seconds from the time in each frame, that is, the positive minute to the received data accumulating means 206.

In the eighth embodiment, the reception of the standard radio signal is performed once every hour or every day to correct the time held by the repeating installation. When the reception is performed every hour, the reception is performed at the time having the same minute value. When the reception is performed once a day, it is performed at the predetermined time. The reception is performed at a relatively high frequency in this manner, and the time held by the repeating installation is correctly kept. The received time data is transmitted to the subsidiary equipment by a transmission circuit 214 through a transmission antenna 215. For the transmission, since the power consumption is large, instead of performing the transmission for every reception, the frequency is lowered by performing the transmission once a day for the reception of every hour, or performing the transmission once a week for the reception of once a day.

Control means 213 is disposed to control the reception and transmission, and is constituted of reception start means 213*a* and transmission start means 213*b*. The reception start means 213*a* stores the reception time and counts the reception cycle. The cycle is 60 minutes for every hour reception, and 24 hours for the reception of once a day. The reception start means 213*a* refer to the time information of the main counter 210, and outputs a reception start command to the ON time counter 211 at a fixed time after the elapse of the predetermined cycle. The ON time counter 211 starts operating in response to the above-described reception start command, and counts necessary and sufficient time for handling one reception on receiving the output of the frequency division circuit 209, and the time is, for example, about three minutes. When the ON time counter 211 begins operation, the ON/OFF means 212 inputs ON signal to the reception circuit 202 to begin reception.

The reception of the time data is periodically performed at the fixed time as described above. When the data is read into the received data accumulating means 206, judging means 207 functions. The judging means 207 reads the data from the received data accumulating means 206, judges whether the data is appropriate, updates the time of the main counter 210 when the data is appropriate, transmits a stop signal to the ON time counter 211, stops the counter and ends this reception. When the data is inappropriate, an impossible time, for example, the time exceeding 24:00 is received. This possibly occurs by a defect of radio wave state, an incorrect operation of reception circuit, and the like. When the received data is unusual, the judging means 207 does not update the main counter 210.

On the other hand, the transmission start means 213*b* stores the transmission time of the time data for the subsidiary equipment and counts the transmission cycle. As described above, the frequency of the transmission is lowered below that of the reception. When the reception is performed every hour, the transmission is performed once a day. When the reception occurs once a day, the transmission occurs once a week. The cycle is 24 hours or seven days. The transmission time is set to the transmission start means 213*b* a short time after the reception time set to the reception start means 213*a* because particularly a relation with the reception time is made much of in the present invention. The transmission start means 213*b* refers to the time information of the main counter 210, outputs a transmission start command to the transmission circuit 214 at the fixed time after the elapse of the predetermined cycle and transmits the time data to the subsidiary equipment, while the subsidiary equipment receives this to update its time counter.

Figure 17:
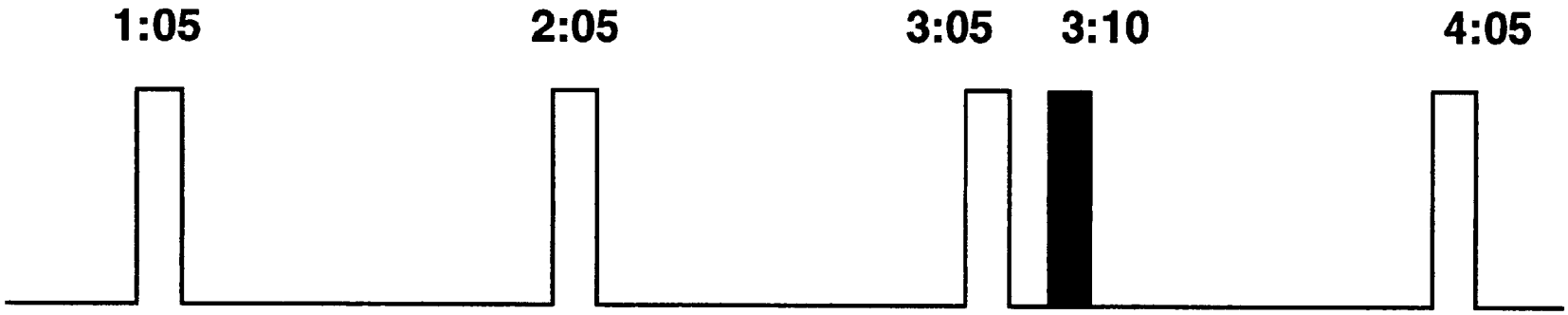
FIG. 17 is a timing chart showing the operation of the eighth embodiment.

FIG. 17 is a timing chart showing the operation of the repeating installation shown in FIG. 16, and the setting of the reception start time and transmission start time in the eighth embodiment will next be described while referring to this figure.

In the setting of the operation time of FIG. 17, the reception is set once an hour, and the reception start means 213*a* issues a reception start command five minutes past every positive hour. FIG. 17 shows the settings with a plurality of pulses with the reception times attached thereto. As described above, even when the radio wave is received every hour, the transmission to the subsidiary equipment is performed once a day, and this is shown by a blackened pulse. As shown in FIG. 17, the transmission is performed at 3:10 a.m., that is, five minutes after the data reception performed at 3:05 a.m.

In the eighth embodiment the transmission time is set to 3:10 every day by following the example in Europe in which the changeover to the summer time or the winter time is performed at 3:00 a.m. By receiving the standard radio signal once every hour to update the time data of the repeating installation, and transmitting the time data to the subsidiary equipment once a day to correct the time data of the subsidiary equipment, a sufficiently correct operation is obtained as the clock displaying the ordinary time without particularly considering the reception or transmission time. When the summer time is considered, however, the reception start time must be properly selected.

When the transmission start time is set to 2:10 a.m. in an extreme example, the time of the subsidiary equipment is updated by the time information based on the winter time received at 2:05 a.m. on the day of changeover to the summer time, the summer time starts one hour after the reception, and the main counter of the repeating installation is updated, but the time display of the subsidiary equipment is still in winter time over 23 hours until the transmission of the next day.

To avoid this situation, as shown in FIG. 17, the reception start time is set five minutes after each positive hour. When the transmission start time of once a day is set to 3:10, this is received five minutes after the changeover to the summer time from the winter time, the main counter of the repeating installation is updated, and the time correction of the subsidiary equipment is performed by the summer time further five minutes later. This also applies to the changeover to the winter time from the summer time. Summer time is not always executed with the same timing as that described above, but, regardless, the changeover time is determined some time prior to its execution. Therefore, with respect to the reception start time and transmission start time set to the repeating installation, the reception start time is set at the same time as or a short time after the predetermined changeover time, and the transmission start time is set a short time after the reception start time. In other words, it is preferable to place the transmission start time before the middle between the reception start time and the next reception start time at latest.

In the timing chart shown in FIG. 17, because the repeating installation and the subsidiary equipment perform the transmission/reception once a day, the changeover to summer time can be immediately handled, but, as described above, with one transmission/reception in one week for the power consumption saving, the changeover to the summer time requires no longer than one week at most. A method of utilizing the advance notice bit included in the standard radio signal to solve this problem will be described hereinafter.

According to the format of the scheduled standard radio signal, the standard radio signal also includes the information concerning summer time, and one of the information is an advance notice bit (SU1). This data is of one bit, turns to one several days before the changeover to the summer time (or vice versa), and turns to zero at the same time as the changeover. In the repeating installation of FIG. 16 the judging means 207 is constituted to monitor this advance notice bit, and outputs the changeover signal to the control means 213 when detecting that the advance notice bit changes to zero from one at 3:05, that is, the reception time.

Figure 18:
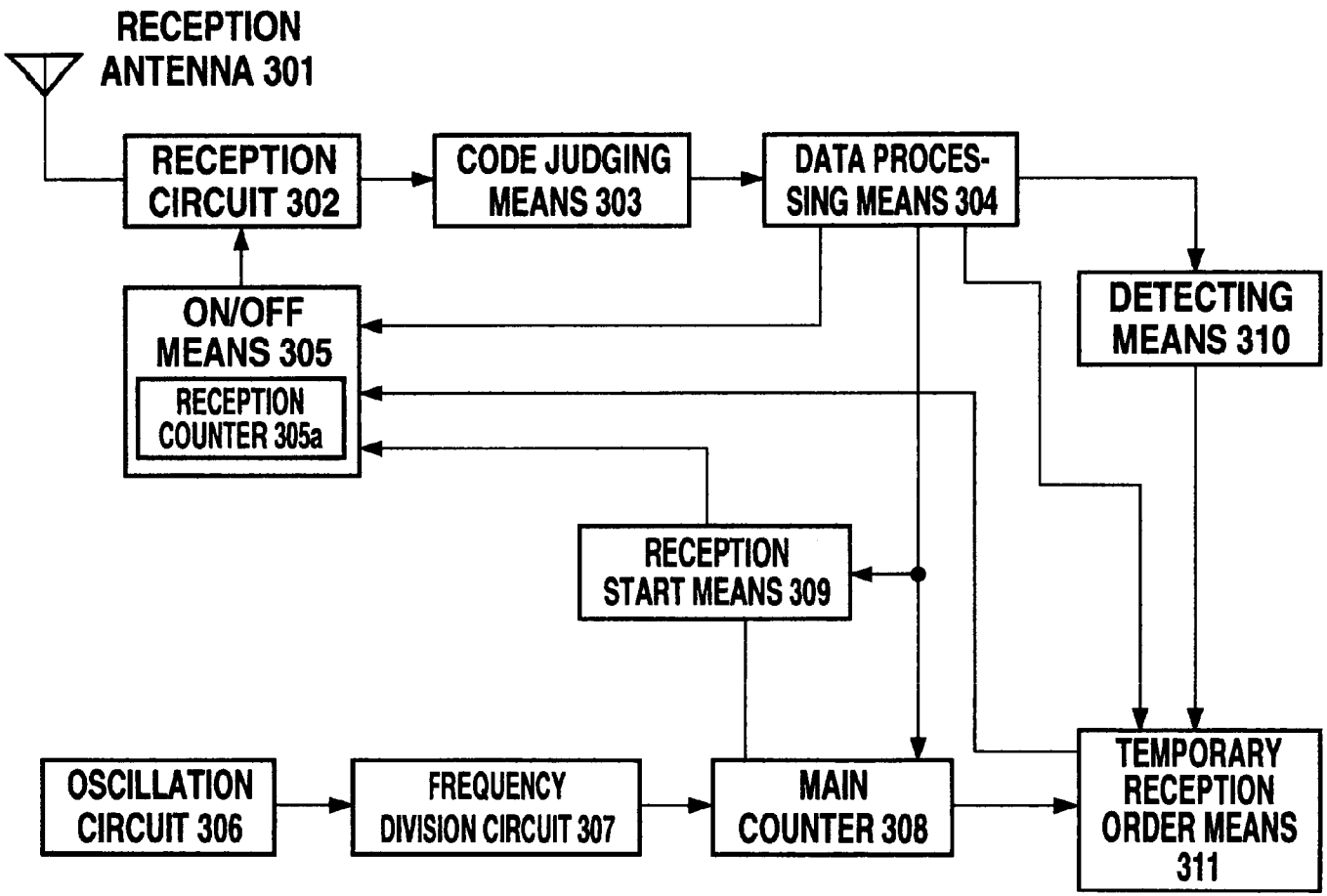
FIG. 18 is a block diagram showing the constitution of the subsidiary equipment according to the eighth embodiment of the present invention.

FIG. 18 is a circuit block diagram showing the subsidiary equipment in the eighth embodiment. In FIG. 18, numeral 301 denotes an antenna for receiving the signal outputted from the transmission antenna of the repeating installation, 302 denotes a reception circuit for performing the amplification, filter processing, and wave detection of the signal received by the reception antenna 301, 303 denotes code judging means for judging the code from the demodulated waveform of the reception circuit 302, 304 denotes data processing means for processing the code outputted from the code judging means 303 to provide time information or the like, 305 denotes ON/OFF means for turning on the reception circuit 302 based on a reception command signal from reception start means 309 described later, 305*a* denotes a reception counter for counting while reception is performed, 306 denotes an oscillation circuit, 307 denotes a frequency division circuit, and 308 denotes a main counter for holding time. Numeral 309 denotes reception start means for outputting the reception command signal to the ON/OFF means once at the predetermined time (3:05 here) in one week based on the time information from the main counter, 310 denotes detecting means for detecting the advance notice content outputted from the data processing means 304, and 311 denotes temporary reception order means for operating based on the signal outputted from the detecting means 310 and outputting the reception command at the predetermined time every day during the operation.

The operation of the above-described subsidiary equipment will now be described.

One week after the initial setting state, the reception start means 309 outputs a reception command signal to the ON/OFF means 305. The ON/OFF means 305 places the reception circuit 302 in the operation condition based on the signal. The reception circuit 302 starts reception, and performs the amplification, frequency filter processing, and wave detection of the radio wave obtained from the antenna 301, and the wave detection result is output from this reception circuit 302. From the wave detection result, the code judging means 303 judges the code, and the data processing means 304 performs a data processing to generate the time data and calendar data. Here when the data is not non-present data, the data processing means 304 outputs the obtained data to the main counter 308, updates the value of the main counter, and simultaneously outputs the reception end signal to the ON/OFF means 305. For the non-present data and other unrecognizable data, the value of the main counter 308 is not updated, and the reception is continued to obtain the next data. When the counter for counting the reception time in the ON/OFF means 305 exceeds a certain constant value, the reception ends. If no correct data can be obtained during this time, the data of the main counter 308 is not updated. However, the reception start means 309 is automatically updated because, even when the correct time cannot be received, the reception command signal is outputted seven days later. When valid data can be obtained, the data of the main counter 308 is updated as described above, and the reception start means 309 is also updated. Therefore, the receiving operation is performed again one week later. Here, when the detecting means 310 detects that the change bit SU1 to the summer time is 1, the temporary reception order means 311 is placed in its operation state, and outputs the reception command to the ON/OFF means 305 at 3:05 every day. Therefore, when the changeover advance notice bit to the summer time is output, the subsidiary equipment performs reception once at the predetermined time (3:05 in this example) every day.

Figure 19:
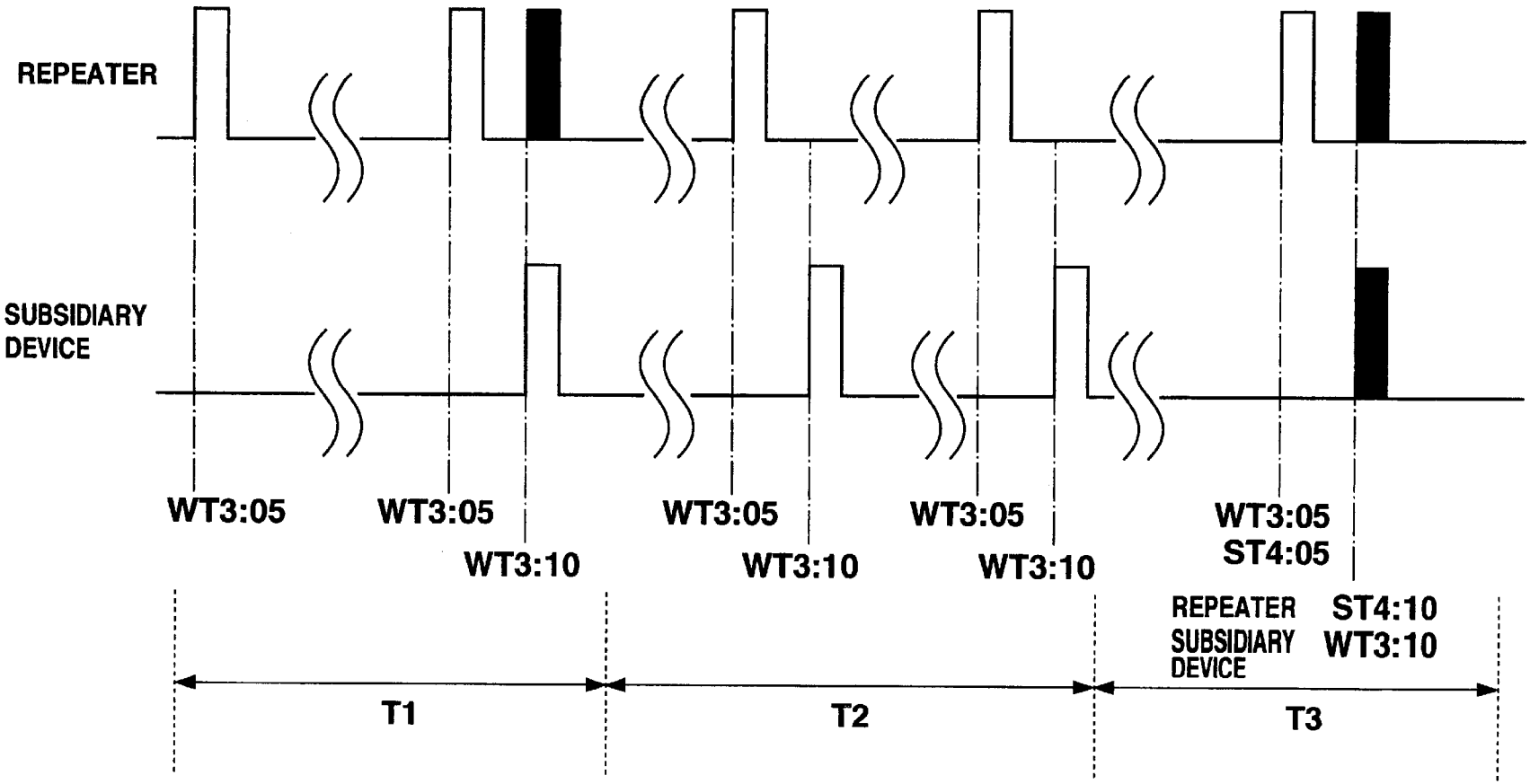
FIG. 19 is a timing chart showing the operation of the eighth embodiment.

The transmitting/receiving operation of the repeater and the subsidiary equipment of the eight embodiment will now be described with reference to a time chart shown in FIG. 19.

First the initialization setting is performed to allow the main counter 210 of the repeater to agree with the main counter 308 of the subsidiary equipment. In the ordinary state the repeater performs the receiving operation at 3:05 every day and performs the transmitting operation at 3:10 every seven days. Because the subsidiary equipment is initially set to perform reception at the transmission day and time of the repeater, the transmission/reception is performed at 3:10 once a week, so that the subsidiary equipment is corrected. In FIG. 19 section T1 shows this state.

Here when the summer time is scheduled one week later, the advance notice bit SU1 of the standard radio signal is changed to 1. The repeater transmits this information together with the time data to the subsidiary equipment. Transmission is performed once a week, but the changeover of the advance notice bit is also performed one week before, and the changeover information can securely be received by the subsidiary equipment. The detecting means 310 of the subsidiary equipment receives this information and outputs the signal to the temporary reception order means 311. Therefore, the temporary reception order means 311 is placed in its operation state, and outputs the reception command to the ON/OFF means 305 at 3:10 every day. Therefore, the subsidiary equipment is in the reception state every day. Section T2 of FIG. 19 shows this state.

On the other hand, the transmission start means 213*b* of the control means 213 of the repeater shown in FIG. 16 counts the cycle of one week in the eighth embodiment. On receiving the changeover signal from the judging circuit 207, the transmission start means instructs the transmission circuit 214 at 3:10 five minutes after the reception to transmit the time data to the subsidiary equipment even when the day is not an original transmission day. Because the subsidiary equipment is in the reception state at this transmission time, time correction is performed. Therefore, the subsidiary equipment can immediately perform reception at the changeover to the summer time. This state is shown in FIG. 19 as T3.

Subsequently, the repeater resets the counter of the transmission cycle, so that the next transmission is performed one week after this time. When the reception is successful, the temporary reception order means 311 of the subsidiary equipment receives data from the data processing means 304, and is reset to stop its operation. On the other hand, the reception start means 309 is also initialized and thereafter the subsidiary equipment is placed in the reception state every other week.

The eighth embodiment can provide the following effects.

1. By receiving the standard radio signal to correct the holding time of the repeating installation, and transmitting the time data with a frequency lower than that of the reception to correct the holding time of the subsidiary equipment, an accurate time value can be maintained and power can be saved. By performing transmission a short time after the reception, the time of the subsidiary equipment is corrected without delay.

2. When transmission is performed every day, by the constitution of setting the reception time at the same time as or immediately after the predetermined changeover time in the summer time or the like, and performing transmission a short time after the reception, the repeating installation and the subsidiary equipment follow a new time system a short time after the changeover.

3. When transmission does not occur every day, in the constitution for monitoring the advance notice bit change, by detecting the time changeover immediately after the changeover, and immediately transmitting the time data to the subsidiary equipment regardless of the previous transmission schedule, the holding time of the repeating installation and subsidiary equipment can securely be updated on the changeover day.

This realizes the repeating installation-subsidiary equipment system in which the accurate time is always held and the intentional changeover of the time system can immediately be handled.

Figure 20:
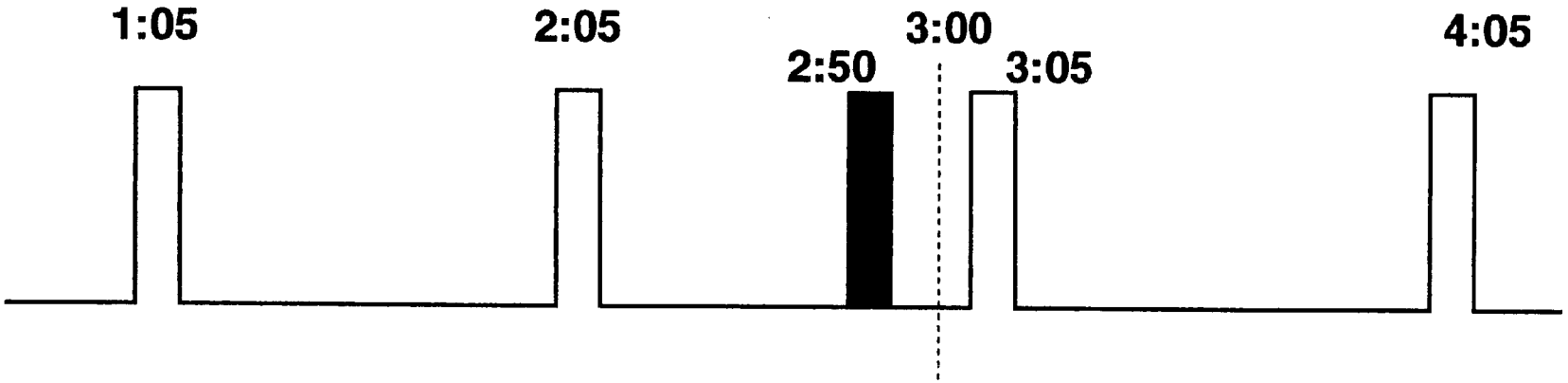
FIG. 20 is a timing chart showing the operation of the time information repeating installation according to a ninth embodiment of the present invention.

A ninth embodiment of the present invention will next be described. Because the constitution block of the time information repeating installation of this embodiment is the same as that of FIG. 16, the block diagram is omitted, and FIG. 16 is used instead. The description of the similar constitution is omitted. FIG. 20 is a timing chart showing the operation of the ninth embodiment.

The reception start means 213*a* stores the reception time, and stores 24 reception times such as 1:05, 2:05, 3:05, 4:05, . . . as shown in FIG. 20. The reception start means 213*a* refers to the time information of the main counter 210, and outputs the reception start command to the ON time counter 211 at a certain fixed time as the stored reception time. The ON time counter 211 starts operating in response to the above-described reception start command, and counts the necessary and sufficient time for handling one reception on receiving the output of the frequency division circuit 209, and the time is, for example, about three minutes. When the ON time counter 211 starts operating, the ON/OFF means 212 inputs the ON signal to the reception circuit 202 to start reception.

On the other hand, the transmission start means 213*b* stores the transmission time of the time data for the subsidiary equipment and stores 2:50 once a day in the ordinary case. As described above, the frequency of the transmission is lowered below that of the reception. When reception is performed every hour, the transmission is performed once a day. The transmission time is set to the transmission start means 213*b* a short time as ten minutes before the positive hour, that is, the timing of 50 minutes in the ordinary case because the reception timing of the subsidiary equipment is made much of in the ninth embodiment. The transmission start means 213*b* refers to the time information of the main counter 210, outputs the transmission start command to the transmission circuit 214 at the transmission time 2:50 as described above and transmits the time data to the subsidiary equipment, while the subsidiary equipment receives this to update its time counter.

In the setting of the operation time of FIG. 20 the reception is set once an hour, and the reception start means 213*a* issues the reception start command five minutes past every positive hour. FIG. 20 shows the settings with a plurality of pulses with the reception times attached thereto. Even when the radio wave is received every hour, the transmission to the subsidiary equipment is performed once a day, and this is shown by a blackened pulse. As shown in FIG. 20, the transmission is performed at 2:50 a.m., that is, ten minutes before the positive hour in the ordinary case.

However, when the transmission timing is set to 2:50 a.m. even at the changeover between the summer time and the winter time, and when the changeover between the summer time and the winter time is performed at 3:00 a.m. as is common in Europe, with the transmission of once a day, the correct time information to the subsidiary equipment via the time information repeating installation after the changeover is supplied after 23:50. Even at the timing of 50 minutes once an hour, the correct time information to the subsidiary equipment after the changeover of the summer time is supplied 50 minutes later. Therefore, by receiving the standard radio signal once an hour to update the time data of the time information repeating installation, and transmitting the time data to the subsidiary equipment once a day to correct the time data of the subsidiary equipment, sufficiently accurate operation can be obtained as the clock indicating the ordinary time without particular consideration the reception or transmission time. However, when the summer time is considered, the transmission start time from the time information repeating installation has to be adequately selected.

To avoid this situation, the changeover advance notice information of the summer time and winter time of the advance notice bit included in the standard radio signal is utilized to solve this problem in the ninth embodiment. According to the format of the scheduled standard radio signal, the standard radio signal also includes information concerning summer time, including the advance notice bit (SU1). This one bit data value switches to 1 several days (within six days) before the changeover to the summer time (or vice versa), and reverts to 0 at the same time as the changeover. In the repeating installation of FIG. 16 the judging means 207 is constituted to monitor this advance notice bit, and outputs the changeover signal to the control means 213 when detecting that the advance notice bit changes to 1 from 0 at 2:05, that is, the reception time.

A subsidiary device of this embodiment will next be described. Because the circuit block constitution of the subsidiary device in the ninth embodiment is the same as that of FIG. 18, FIG. 18 is used instead, and description will not be repeated.

The reception start means 309 outputs the reception command signal to the ON/OFF means 305 based on the time information from the main counter once a day at the predetermined time (2:50 here). The temporary reception order means 311 operates based on the signal outputted from the detecting means 310, and outputs the reception command at the 2:50, and additionally 3:10 every day during the operation.

The operation of the above-described subsidiary equipment is basically the same as that described in the eighth embodiment, but will be described for confirmation.

The reception start means 309 outputs the reception command signal to the ON/OFF means 305 every day. The ON/OFF means 305 places the reception circuit 302 in the operation condition based on the signal. The reception circuit 302 starts reception, and performs the amplification, frequency filter processing, and wave detection of the radio wave obtained from the antenna 301, and the wave detection result is outputted from this reception circuit 302. From the wave detection result, the code judging means 303 judges the code, and the data processing means 304 performs a data processing to generate the time data and calendar data. Here when the data is not non-present data, the data processing means 304 outputs the obtained data to the main counter 308, updates the value of the main counter, and simultaneously outputs the reception end signal to the ON/OFF means 305. For the non-present data and other unrecognizable data, the value of the main counter 308 is not updated, and the reception is continued to obtain the next data. When the value of the counter for counting the reception time in the ON/OFF means 305 exceeds a certain constant value, the reception ends. If no valid data can be obtained by this time, the data of the main counter 308 is not updated. However, the reception start means 309 is automatically updated (the reason is that even when the correct time cannot be received, the reception command signal is outputted 24 hours later). When the correct data can be obtained, the data of the main counter 308 is updated as described above, and the reception start means 309 is also updated. Therefore, the receiving operation is performed again 24 hours later. Here, when the detecting means 310 detects that the change bit SU1 to the summer time is 1, the temporary reception order means 311 is placed in its operation state, and outputs the reception command to the ON/OFF means 305 at 3:10 every day. Therefore, when the changeover advance notice bit to the summer time is output, the reception of 3:10 is added to the subsidiary equipment which performs reception at 2:50 in the ordinary case.

Figure 21:
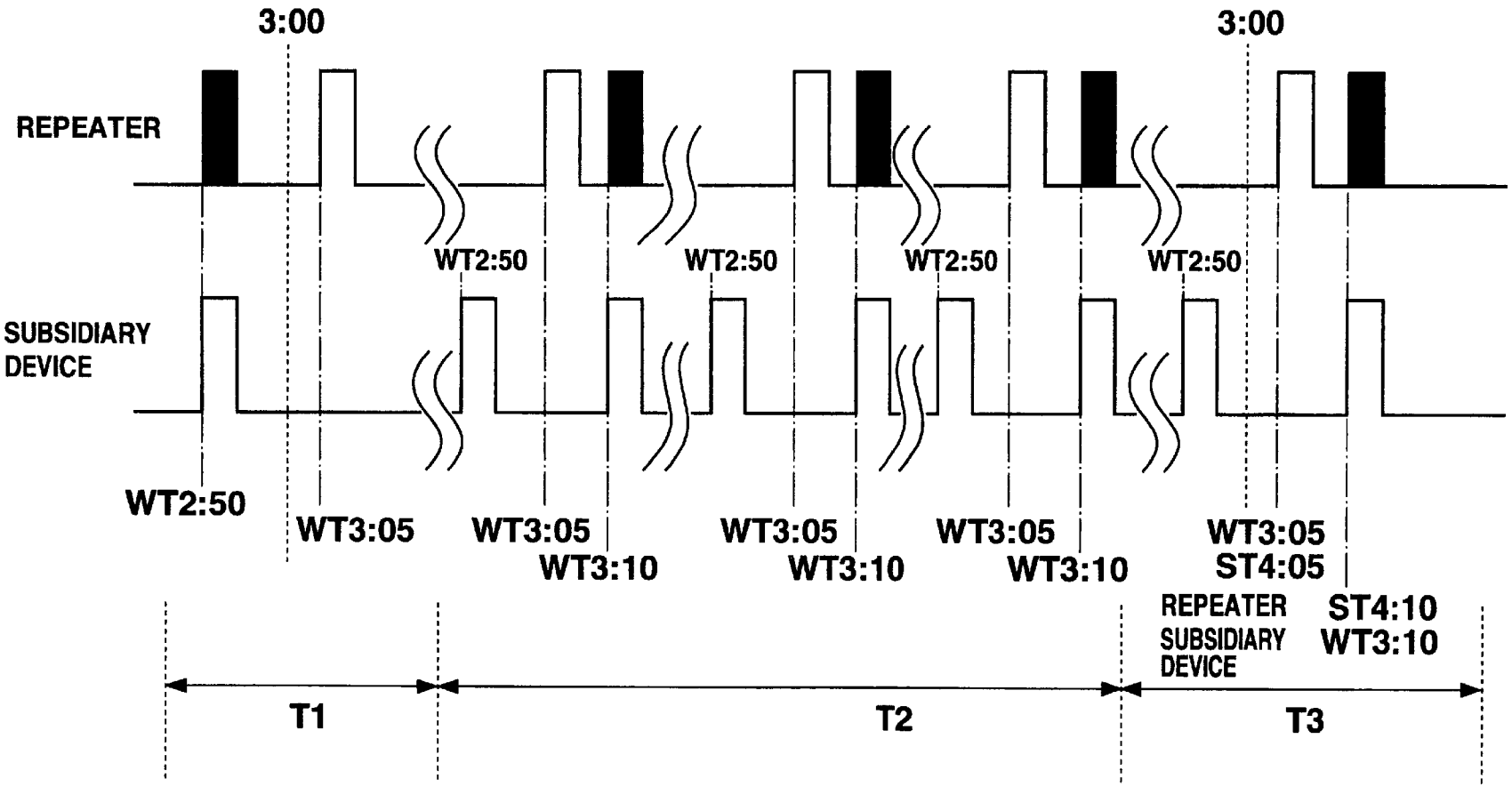
FIG. 21 is a block diagram showing the constitution of the repeating installation and subsidiary equipment of the ninth embodiment.

The transmitting/receiving operation of the repeater and subsidiary equipment as the time information repeating installation of the ninth embodiment will now be described with reference to a time chart shown in FIG. 21.

First the initialization setting is performed to allow the main counter 210 of the repeater to agree with the main counter 308 of the subsidiary equipment. In the ordinary state (ordinary case) the repeater performs the receiving operation at 3:05 every day and performs the transmitting operation at 2:50 every day. Since the subsidiary equipment is initially set to perform reception at the transmission time of the repeater, the reception is performed at 2:50 once a day, so that the subsidiary equipment is corrected. In FIG. 20 section T1 shows this state.

Here, when summer time is scheduled six days from the present, the advance notice bit SU1 of the standard radio signal is changed to 1. The repeater accumulates this information once in the received data accumulating means 206, and transmits this information together with the time data to the subsidiary equipment via the transmission antenna 215 based on the control of the control means 213. The detecting means 310 of the subsidiary equipment receives this information and outputs the signal to the temporary reception order means 311. Therefore, the temporary reception order means 311 is placed in its operation state, and outputs the reception command to the ON/OFF means 305 also at 3:10 every day. Therefore, the subsidiary equipment is in the reception state at 2:50 and 3:10 every day. Section T2 of FIG. 21 shows this state.

Additionally, in the above-described ninth embodiment the subsidiary equipment is placed in the reception state at 2:50 and 3:10 every day when the advance notice bit SU1 is detected, but in the ordinary case, when the reception state is placed at 2:50 every day and the advance notice bit SU1 is detected, a mode can be considered in which the reception state is changed at 3:10.

On the other hand, the transmission start means 213*b* in the control means 213 of the repeater detects and latches 1 of the advance notice bit (SU1) and receives the changeover signal from the judging circuit 207. Therefore, the transmission start means transmits "4:10 time information of summer time" by a transmission time change instruction to the transmission circuit 214 at 3:10, five minutes after the reception based on the control of the control means 213, so that the time data is transmitted to the subsidiary equipment. Subsequently, 1 of the advance notice bit (SU1) is detected. Since the subsidiary equipment is also in the reception state at this transmission time, for example, six days later, the reception is immediately performed and time correction is performed. Additionally, the subsidiary equipment is immediately changed to the summer time. In FIG. 21 T3 shows this state. As shown in T3 of FIG. 21, the reception start time is set five minutes after each positive hour, and the transmission control start time is set once a day at 3:10. Then, this is received five minutes after the changeover to the summer time from the winter time, the main counter of the time information repeating installation is updated, and the receiving operation is completed. A further five minutes later the summer time is transmitted from the time information repeating installation, and the time correction of the subsidiary equipment is quickly performed in accordance with the transmission time information. Similarly the time of the subsidiary equipment is quickly changed even in the changeover to the winter time from the summer time.

It can not be certain that the changeover time as described above will be employed, but, in any case, the changeover time is determined prior to the execution. Therefore, with respect to the reception start time and transmission start time set to the time information repeating installation, when 1 of the advance notice bit (SU1) is detected, the time is preferably set a short time after the predetermined changeover time of the summer time which is the positive hour. Moreover, in this case, when the reception start time is set between the summer time changeover time which is the positive hour of the time information repeating installation, and the transmission start time as described above, the changeover of the summer time can most quickly be realized in the subsidiary equipment via the time information repeating installation.

Moreover, when the reception is successful, the temporary reception order means 311 of the subsidiary equipment receives data from the data processing means 304, and is reset to stop its operation. On the other hand, the reception start means 309 is also initialized and thereafter the reception time of the subsidiary equipment is returned only to 2:50. When the changeover between summer time and winter time is carried out, the advance notice bit (SU1) returns to 0 from 1. After this is detected by the judging means 207 and the detected information latched to the transmission start means 213*b* is reset, control is performed so that the transmission control start time is returned to 2:50 in the ordinary case from 3:10.

In the ninth embodiment, even when the transmission timing of the time information repeating installation is set to a timing slightly before the positive hour (e.g., 2:50 a.m.) in the ordinary case, by detecting 1 of the advance notice bit (SU1) as the changeover information of the summer time and changing the transmission timing to a timing a little after the positive hour (e.g., 3:10 a.m.), the changeover to the correct time can quickly be realized, even during the changeover to summer time, without damaging the product power of the radio wave correction clock as the subsidiary equipment.

Moreover, when the summer time changeover advance notice bit is detected, by setting the reception timing (e.g., 3:05 a.m.) between the positive hour and the transmission timing during the detection (e.g., 3:10 a.m.), the effect is further increased.

What is claimed is:

1. A time information repeating installation comprising:

receiving means for receiving information including standard time information;

timing means for measuring time based on the time information obtained by the receiving means;

transmitting means for transmitting, at a predetermined time, the information obtained from the receiving means; and change recognizing means for recognizing a change of said standard time information, wherein said transmitting means performing a transmitting operation based on an output of the change recognizing means at a time different from said predetermined time.

2. The time information repeating installation according to claim 1 wherein said change recognizing means comprises advance notice information recognizing means for recognizing changeover advance notice information of the standard time information.

3. The time information repeating installation according to claim 2 wherein the advance notice information recognizing means comprises detecting means for detecting a time change advance notice bit included in the standard time information.

4. The time information repeating installation according to claim 1 wherein said transmitting means performs the transmitting operation at said predetermined time and at a time interval corresponding to correction time recognized by said change recognizing means.

5. The time information repeating installation according to claim 1 further comprising change period setting means for setting a period in which said transmitting means performs the transmitting operation at the time different from said predetermined time.

6. The time information repeating installation according to claim 5 wherein the value for the change period of said change period setting means can be adjusted.

7. The time information repeating installation according to claim 2 wherein the change recognizing means for recognizing the change of said standard time information recognizes a changeover of summer time and winter time.

8. The time information repeating installation according to claim 1 wherein said change recognizing means comprises computing means for computing a difference between the time information obtained by said receiving means and the time measured by said timing means, and said transmitting means performs the transmitting operation at the time based on said difference to said predetermined time when the difference output from the computing means is greater than or equal to a predetermined value.

9. The time information repeating installation according to claim 8 wherein said change recognizing means further comprises advance notice information recognizing means for recognizing advance notice information, and said computing means operates upon receiving an output of the advance notice information recognizing means.

10. The time information repeating installation according to claim 9 wherein said advance notice information recognizing means comprises detecting means for detecting a time change advance notice bit included in said standard time information.

11. The time information repeating installation according to claim 8 wherein said change recognizing means further comprises calendar information holding means for holding the present calendar information, changeover day holding means for holding a time information changeover day, and comparing means for comparing the calendar information held by the calendar information holding means and the changeover day information holding means.

12. A time information control system comprising:

the time information repeating installation according to any one of claims 1 to 11, and a time display for receiving information outputted at least from the time information repeating installation at a predetermined time.

13. A time information control system comprising:

a time information repeating installation comprising receiving means for receiving information including standard time information, timing means for measuring time based on the time information obtained by the receiving means, and transmitting means for transmitting the information obtained from the receiving means at a predetermined time; and a time display comprising receiving means for receiving the information transmitted from at least the time information repeating installation at a predetermined time, timing means for measuring the time based on the time information obtained by the receiving means, and change recognizing means for recognizing a change of said standard time information, wherein the receiving means of the time display performing a receiving operation based on the output of the change recognizing means at the time different from said predetermined time.

14. The time information control system according to claim 13 wherein the transmitting means of said time information repeating installation transmits a time change advance notice bit included in said standard time information, and said change recognizing means comprises detecting means for detecting the time change advance notice bit of said standard time information.

15. The time information control system according to claim 13 wherein the receiving means of said time display performs reception even at said predetermined time.

16. The time information control system according to claim 13 further comprising change period setting means for setting a period in which the receiving means of said time display performs the reception at the time different from said predetermined time.

17. The time information control system according to claim 16 wherein the setting for the change period of said change period setting means can be adjusted.

18. The time information control system according to claim 13 wherein said change recognizing means comprises calendar information holding means for holding the present calendar information, changeover day holding means for holding a time information changeover day, and comparing means for comparing the calendar information held by both holding means.

19. The time information control system according to claim 13 wherein the change recognizing means for recognizing the change of said standard time information recognizes a changeover to summer time and winter time.

20. A time information repeating installation comprising:

receiving means for receiving a signal including standard time information;

transmitting means for transmitting the time information obtained from the signal to a subsidiary equipment; and control means for controlling transmission and reception timings, such that, when a discontinuous changeover of said standard time information is scheduled, a reception time is set to the same time as a predetermined changeover time or a short time after the changeover time in said control means, and a transmission time is set to a short time after the reception time.

21. The time information repeating installation according to claim 20 wherein an interval from the reception time to said transmission time is set to be shorter than the interval to the next reception time.

22. The time information repeating installation according to claim 20 wherein the predetermined transmission timing by said control means is normally set to a short time before a positive time, and is changed to a short time after the positive time during detection of advance notice information of said discontinuous changeover.

* * * * *